US009376278B2

(12) United States Patent
Watanabe

(10) Patent No.: US 9,376,278 B2
(45) Date of Patent: Jun. 28, 2016

(54) SHEET-CONVEYING APPARATUS

(71) Applicant: BROTHER KOGYO KABUSHIKI KAISHA, Nagoya, Aichi (JP)

(72) Inventor: Tomonori Watanabe, Ichinomiya (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 0 days.

(21) Appl. No.: 14/609,980

(22) Filed: Jan. 30, 2015

(65) Prior Publication Data

US 2015/0217957 A1 Aug. 6, 2015

(30) Foreign Application Priority Data

Jan. 31, 2014 (JP) ..... 2014-017893

(51) Int. Cl.

| | |
|---|---|
| ***B65H 7/02*** | (2006.01) |
| ***B65H 7/06*** | (2006.01) |
| ***B65H 7/12*** | (2006.01) |
| ***B65H 3/06*** | (2006.01) |
| ***B65H 3/52*** | (2006.01) |

(52) U.S. Cl.

CPC ..... *B65H 7/06* (2013.01); *B65H 3/0684* (2013.01); *B65H 3/5223* (2013.01); *B65H 7/02* (2013.01); *B65H 7/12* (2013.01); *B65H 2403/53* (2013.01); *B65H 2553/612* (2013.01)

(58) Field of Classification Search

CPC ..... B65H 7/02; B65H 7/06; B65H 7/12; B65H 2553/612

See application file for complete search history.

(56) References Cited

U.S. PATENT DOCUMENTS

| | | | | |
|---|---|---|---|---|
| 5,082,384 | A * | 1/1992 | Kakaguchi | B41J 29/44 400/605 |
| 5,482,265 | A | 1/1996 | Nakazato et al. | |
| 5,615,876 | A * | 4/1997 | Yergenson | B65H 7/06 271/258.01 |
| 5,964,460 | A * | 10/1999 | Azumi | B65H 3/0661 271/258.01 |
| 6,926,272 | B2 * | 8/2005 | Carter | B65H 7/02 271/258.01 |
| 8,608,154 | B2 * | 12/2013 | Yamada | G03G 15/6502 271/164 |

(Continued)

FOREIGN PATENT DOCUMENTS

| | | | |
|---|---|---|---|
| JP | H05-58481 | A | 3/1993 |
| JP | H05-201557 | A | 8/1993 |
| JP | H05-319630 | A | 12/1993 |

(Continued)

*Primary Examiner* — Jeremy R Severson

(74) *Attorney, Agent, or Firm* — Scully, Scott, Murphy & Presser, PC

(57) ABSTRACT

In a sheet-conveying apparatus, a first arm is disposed between a pick roller and a downstream end of a separator in a conveying direction in which a sheet is conveyed, and a second arm disposed downstream of the separator in the conveying direction. The first arm is movable from a non-detection position to a detection position when contacted by a sheet. The second arm is movable from a non-detection position to a detection position when contacted by a sheet. The sheet-conveying apparatus further includes a sensor configured to output a sensor-signal corresponding to positions of the first and second arms. The sensor outputs a first signal when at least one of the first arm and the second arm is disposed in the detection position. The sensor outputs a second signal other than the first signal when both the first and second arms are disposed in the detection positions.

20 Claims, 17 Drawing Sheets

(56) References Cited

U.S. PATENT DOCUMENTS

| | | | | |
|---|---|---|---|---|
| 8,810,874 | B2 * | 8/2014 | Kuo | B65H 85/00 271/258.01 |
| 2001/0022422 | A1 | 9/2001 | Tamura | |
| 2005/0052484 | A1 | 3/2005 | Horiuchi | |
| 2008/0063449 | A1 | 3/2008 | Fukasawa et al. | |
| 2010/0001455 | A1 | 1/2010 | Miwa et al. | |
| 2015/0028535 | A1 * | 1/2015 | Morimoto | B65H 5/06 271/110 |

FOREIGN PATENT DOCUMENTS

| | | | |
|---|---|---|---|
| JP | H06-1495 | A | 1/1994 |
| JP | H06-156794 | A | 6/1994 |
| JP | H09-193496 | A | 7/1997 |
| JP | H09-314936 | A | 12/1997 |
| JP | H11-59965 | A | 3/1999 |
| JP | H11-159965 | A | 3/1999 |
| JP | 2000-159392 | A | 6/2000 |
| JP | 2000-284556 | A | 10/2000 |
| JP | 2001-031284 | A | 2/2001 |
| JP | 2001-278472 | A | 10/2001 |
| JP | 2001-301998 | A | 10/2001 |
| JP | 2002-019997 | A | 1/2002 |
| JP | 2004-099212 | A | 4/2004 |
| JP | 2005-022792 | A | 1/2005 |
| JP | 2005-096450 | A | 4/2005 |
| JP | 2008-056444 | A | 3/2008 |
| JP | 2010-013199 | A | 1/2010 |

* cited by examiner

SHEET-CONVEYING APPARATUS

CROSS REFERENCE TO RELATED APPLICATION

This application claims priority from Japanese Patent Application No. 2014-017893 filed Jan. 31, 2014. The entire content of the priority application is incorporated herein by reference.

TECHNICAL FIELD

The present invention relates to a sheet-conveying apparatus provided with a pick roller and a separator.

BACKGROUND

A conventional sheet-conveying apparatus is provided with a pick roller that conveys recording sheets loaded in the apparatus, and a separator that separates multiple overlapped sheets conveyed by the pick roller. When the sheet-conveying apparatus having this configuration separates recording sheets at the separator, the position of the leading edge of a succeeding recording sheet can vary.

SUMMARY

The disclosure relates to a sheet-conveying apparatus that may reduce or prevent variation in the gap formed between consecutively conveyed sheets.

According to aspects of the disclosure, an example of a sheet-conveying apparatus includes a tray, a pick roller, a control device, a separator, a conveyer, a first arm, a second arm, and a sensor. The tray is configured to hold a plurality of sheets. The pick roller is configured to convey a sheet from the tray. The control device is configured to control the pick roller. The separator is disposed downstream of the pick roller in a conveying direction in which a sheet is conveyed. The separator is configured to separate a preceding sheet from a succeeding sheet when the preceding sheet and the succeeding sheet are conveyed by the pick roller in an overlapped state. The conveyer is disposed downstream of the separator in the conveying direction and is configured to convey a sheet in the conveying direction. The first arm is disposed between the pick roller and a downstream end of the separator in the conveying direction. The first arm is configured to move from a non-detection position to a detection position when contacted by a sheet. The second arm is disposed downstream of the separator in the conveying direction and is configured to move from a non-detection position to a detection position when contacted by a sheet. The sensor is configured to output a sensor-signal corresponding to positions of the first arm and the second arm. The sensor outputs a first signal when at least one of the first arm and the second arm is disposed in the detection position. The sensor outputs a second signal other than the first signal when both the first arm and the second arm are disposed in the detection positions.

BRIEF DESCRIPTION OF THE DRAWINGS

The particular features and advantages of the invention as well as other objects will become apparent from the following description taken in connection with the accompanying drawings, in which.

DETAILED DESCRIPTION

Next, an embodiment of the present invention will be described while referring to FIGS. 1 through 11. First, the overall structure of a laser printer 1 provided with a sheet-feeding device 3 as an example of a sheet-conveying apparatus will be described, after which a detailed description will be given for the featured aspects of the present invention.

Directions in the following description will be based on the perspective of a user using the laser printer 1. Specifically, the right side of the laser printer 1 in FIG. 1 will be called the "front side," the left side will be called the "rear side," the far side will be called the "right side," and the near side will be called the "left side." Further, the top and bottom of the laser printer 1 will be based on the vertical directions in FIG. 1.

Overall Structure of the Laser Printer

Figure 1:
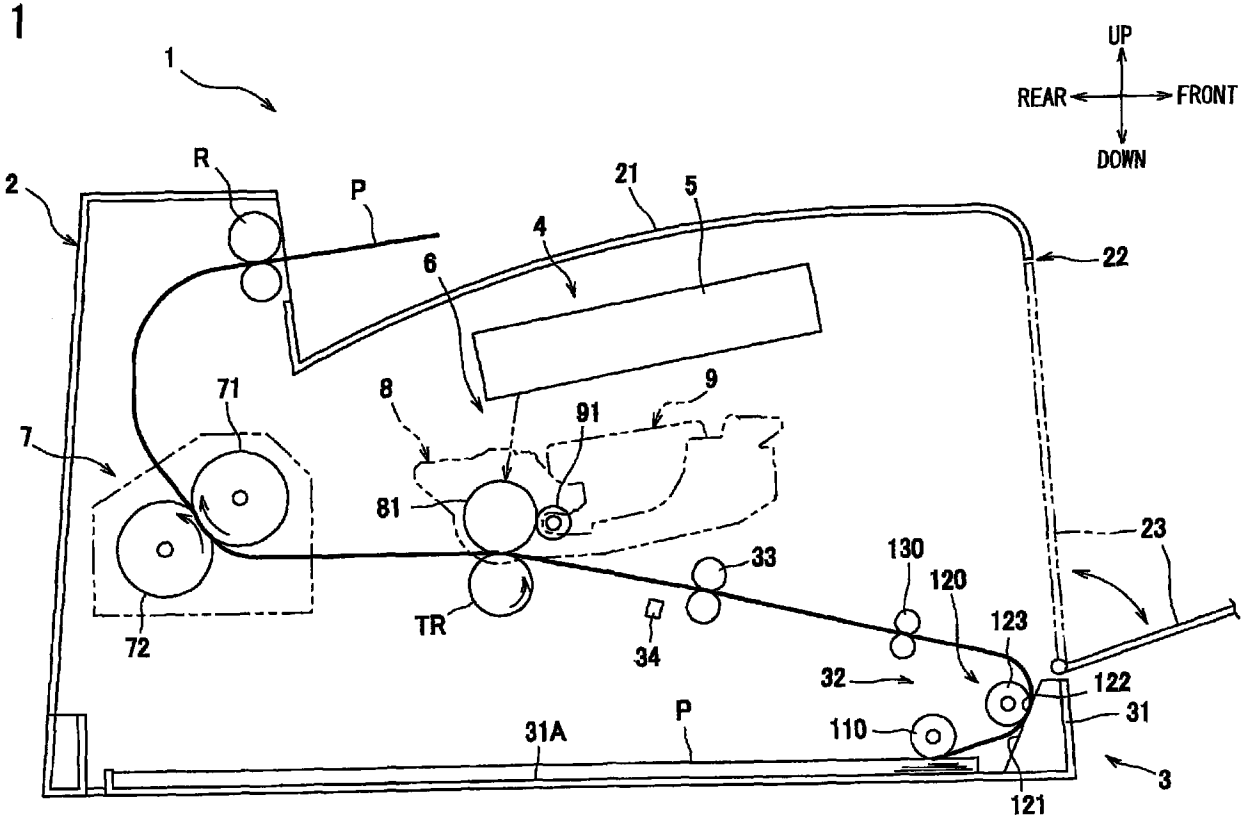
FIG. 1 is a laser printer provided with a sheet-conveying apparatus according to an embodiment of the invention.

As shown in FIG. 1, the laser printer 1 includes a main body 2, a sheet-feeding device 3 configured to supply sheets P of paper serving as an example of a plurality of sheets into the main body 2, and an image-forming unit 4 configured to form images on the sheets P supplied by the sheet-feeding device 3.

The main body 2 constitutes the outer shell of the laser printer 1. The main body 2 includes a discharge tray 21 formed on its top surface, an opening 22 formed in its front side wall for allowing access to the interior of the opening 22, and a front cover 23 rotatably provided on its front wall for covering the opening 22.

The sheet-feeding device 3 includes a paper tray 31 that is detachably mounted in the bottom section of the main body 2 and that is configured to hold a plurality of sheets P, a sheet-conveying mechanism 32 configured to convey the sheets P from the paper tray 31 to the image-forming unit 4, and a pair of registration rollers 33.

The paper tray 31 has a box-like shape and serves as an example of a tray. The top surface in the bottom of the paper tray 31 is a loading surface 31A on which the sheets P are supported or stacked. The loading surface 31A serves as an example of a stacked portion.

The sheet-conveying mechanism 32 primarily includes a pick roller 110, a separator 120 disposed downstream of the pick roller 110 in the conveying direction of the sheets P, and a pair of conveying rollers 130 disposed downstream of the separator 120. The pair of conveying rollers 103 serves as an example of a conveyer. The pick roller 110 is disposed in a position for contacting the top surface of the sheets P loaded in the paper tray 31 and, by rotating, conveys sheets P from the paper tray 31 toward the separator 120. The separator 120 is configured to separate overlapped sheets P when the pick roller 110 feeds a plurality of sheets P simultaneously. The conveying rollers 130 are provided for conveying each sheet P that passes through the separator 120 toward the registration rollers 33.

The registration rollers 33 are positioned between the conveying rollers 130 and a photosensitive drum 81 provided in a process cartridge 6 described later. Before a sheet P is supplied to the photosensitive drum 81, the sheet P is temporarily halted when the leading edge of the sheet P contacts the pair of registration rollers 33. In this way, the registration rollers 33 correct skew in the sheet P and adjust the timing and the like at which an image is formed on the sheet P.

In the sheet-feeding device 3 having the above construction, the pick roller 110 feeds sheets P loaded in the paper tray 31 to a separating roller 123 (described later) provided in the separator 120. Sheets P fed to the separator 120 are separated so that one sheet P at a time is supplied to the image-forming unit 4 by the conveying rollers 130 and registration rollers 33. The structure of the sheet-feeding device 3 will be described later in greater detail.

The image-forming unit 4 includes a scanning unit 5, a process cartridge 6, a transfer roller TR, and a fixing unit 7.

The scanning unit 5 is provided in the top section of the main body 2. While not shown in the drawings, the scanning unit 5 includes a laser light-emitting unit, a polygon mirror, lenses, reflecting mirrors, and the like. A laser beam emitted from the scanning unit 5 is irradiated in a high-speed scan over the surface of the photosensitive drum 81 described later.

The process cartridge 6 can be mounted in and removed from the main body 2 through the opening 22 formed in the main body 2 when the front cover 23 is rotated open. The process cartridge 6 includes a drum cartridge 8, and a developing cartridge 9 detachably mounted in the drum cartridge 8.

While not shown in the drawings, the drum cartridge 8 includes a charger and the like well known in the art, in addition to the photosensitive drum 81 mentioned above on which electrostatic latent images are formed with the scanning unit 5.

The developing cartridge 9 accommodates toner and includes a developing roller 91 for supplying the toner to the photosensitive drum 81. While not shown in the drawings, the developing cartridge 9 also has a supply roller, a thickness-regulating blade, an agitator, and the like well known in the art.

In the process cartridge 6 having this configuration, the charger (not shown) applies a uniform charge to the surface of the rotating photosensitive drum 81. Subsequently, the scanning unit 5 exposes the surface of the photosensitive drum 81 with a laser beam scanned at a high speed. The irradiated light lowers the electric potential in exposed regions on the surface of the photosensitive drum 81, forming an electrostatic latent image on the surface based on image data.

Next, the developing roller 91 is driven to rotate for supplying toner from the developing cartridge 9 onto the latent image formed on the photosensitive drum 81 to produce a toner image on the surface of the photosensitive drum 81. Next, the toner image carried on the surface of the photosensitive drum 81 is transferred onto a sheet P as the sheet P is conveyed between the photosensitive drum 81 and transfer roller TR.

The fixing unit 7 includes a heating roller 71, and a pressure roller 72 that confronts and presses against the heating roller 71. Thus, toner transferred onto a sheet P is fixed to the sheet P in the fixing unit 7 by heat as the sheet P passes between the heating roller 71 and pressure roller 72.

After the toner is thermally fixed to the sheet P in the fixing unit 7, the sheet P is conveyed to a pair of discharge rollers R disposed downstream of the fixing unit 7, and the discharge rollers R discharge the sheet P onto the discharge tray 21 formed on top of the main body 2.

Detailed Structure of the Sheet-Feeding Device

Next, the structure of the sheet-feeding device 3 will be described in greater detail.

Figure 2A:
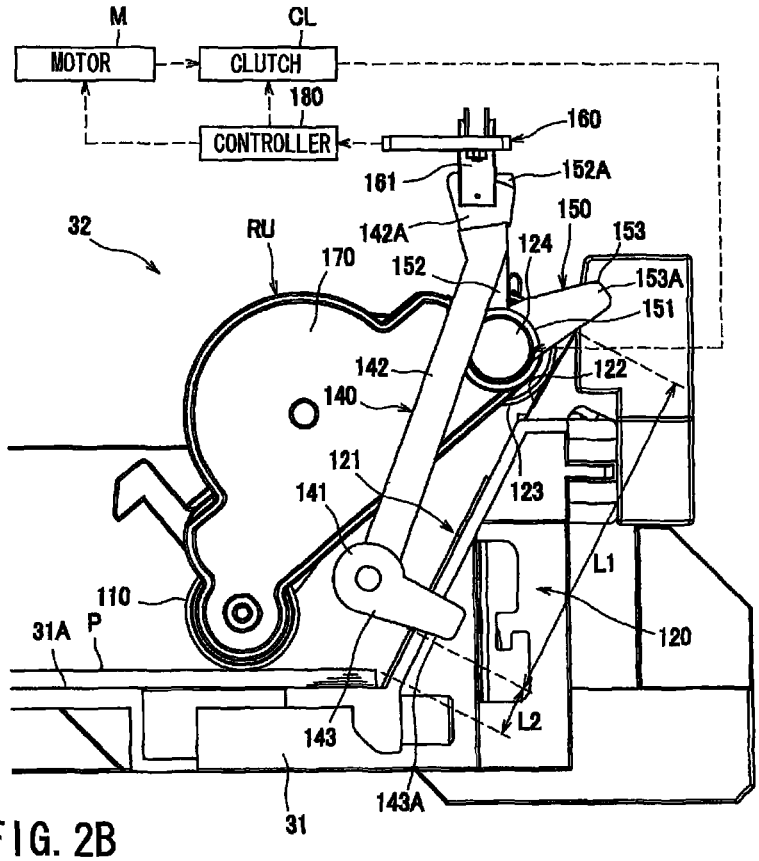
FIG. 2A is a side view of a configuration near the sheet-conveying apparatus.
Figure 3:
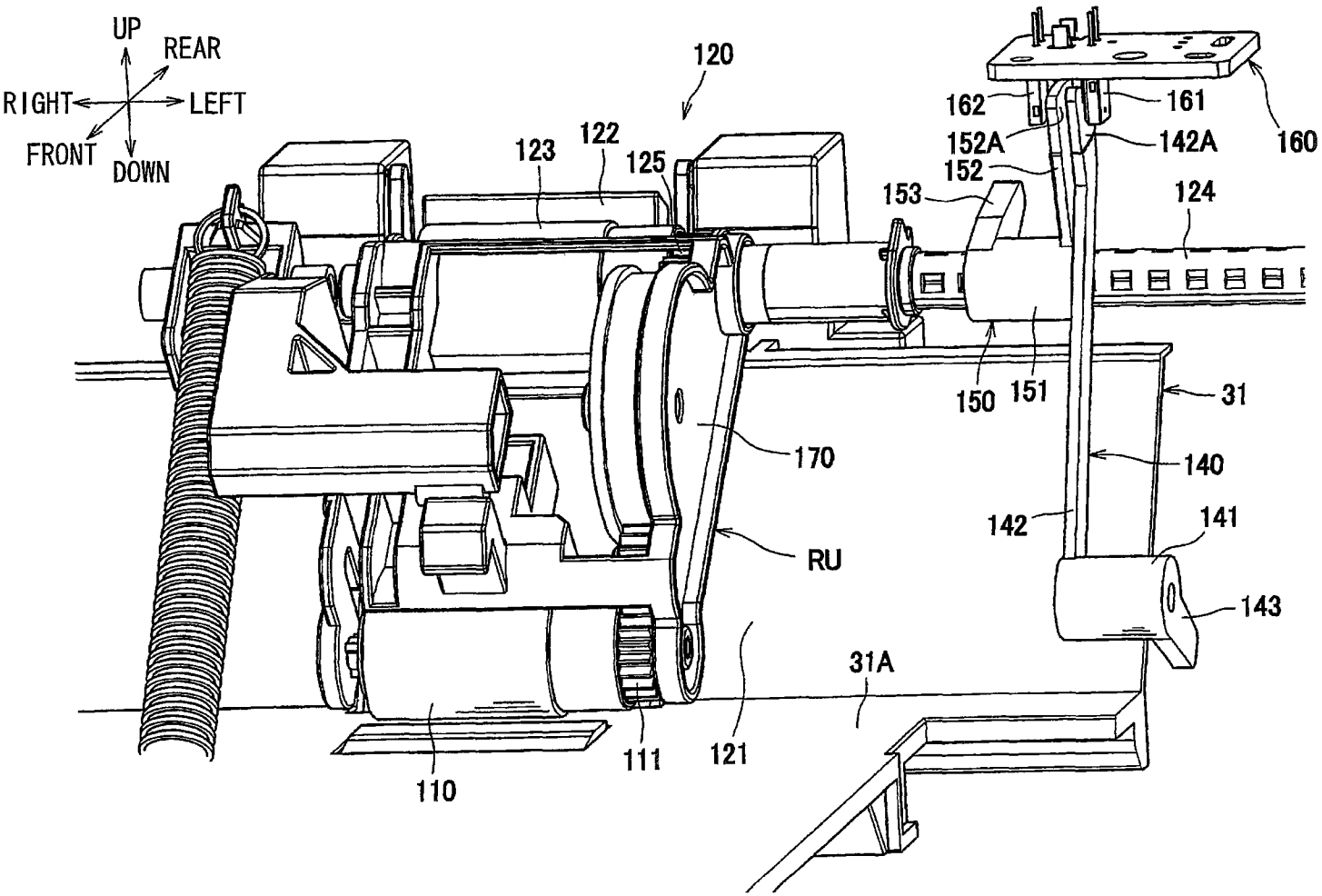
FIG. 3 is a perspective view of the configuration near the sheet-conveying apparatus.

As shown in FIGS. 2A and 3, the sheet-feeding device 3 primarily includes a first arm 140 and a second arm 150 that both move from non-detection positions to detection positions when contacted by a sheet P passing thereby, and a sensor 160 that outputs a signal corresponding to the positions of the first arm 140 and second arm 150, in addition to the pick roller 110, separator 120, and conveying rollers 130 described above.

The separator 120 primarily includes a sloped part 121 provided on the paper tray 31, a separating pad 122 provided on the paper tray 31 downstream of the sloped part 121 in the conveying direction of the sheet P, and a separating roller 123 disposed in confrontation with the separating pad 122.

Figure 2B:
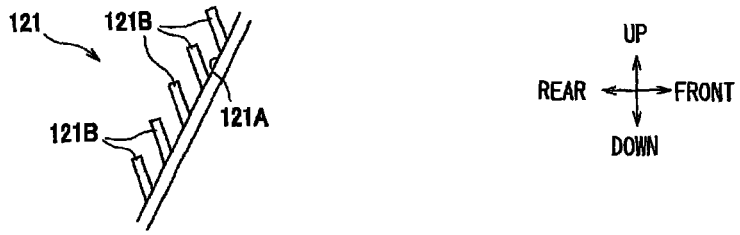
FIG. 2B is an enlarged view of a sloped portion provided near the sheet-conveying apparatus.

As shown in FIGS. 2A and 2B, the sloped part 121 has a sloped surface 121A that is sloped relative to the loading surface 31A of the paper tray 31, extending diagonally upward and forward from the loading surface 31A, and a plurality of separating protrusions 121B that protrude from the surface of the sloped surface 121A at intervals along the conveying direction of the sheet P.

When the pick roller 110 conveys a plurality of sheets P simultaneously in an overlapped state, the separating protrusions 121B in the separator 120 receive the leading edges of the sheets P. Subsequently, the separating pad 122 and separating roller 123 separate and convey the sheets P one at a time toward the conveying rollers 130.

As shown in FIGS. 2A and 3, the pick roller 110 and separating roller 123 are formed as a single unit defined as a sheet-feeding roller unit RU. In addition to the pick roller 110 and separating roller 123, the sheet-feeding roller unit RU is provided with a holder 170 that supports the pick roller 110 and separating roller 123.

The pick roller 110 is rotatably supported in the holder 170. A pick roller gear 111 is fixed to the left end of a shaft in the pick roller 110.

The separating roller 123 is rotatably supported in the holder 170 at a position forward and separated from the pick roller 110 with respect to the front-rear direction and has a rotational shaft running through its axial center. A roller shaft 124 is coupled with the left end of the rotational shaft in the separating roller 123. The roller shaft 124 is rotatably supported in the main body 2 and extends leftward from the left end of the separating roller 123 to a position beyond the left edge of the paper tray 31. A separating-roller gear 125 is fixed to the left end of the rotational shaft in the separating roller 123. The separating-roller gear 125 is coupled with the pick roller gear 111 via idle gears (reference numbers are not provided for the idle gears). With this configuration, the rotation of the roller shaft 124 and separating roller 123 also rotates the pick roller 110.

As shown in FIG. 2A, a motor M is provided in the main body 2. The motor M is connected to a clutch CL connected to the roller shaft 124. The clutch CL can be toggled between an ON state for transmitting a drive force from the motor M to the roller shaft 124, and an OFF state for preventing the transmission of this drive force. The laser printer 1 is provided with a controller 180 for switching the clutch CL on and off. The controller 180 serves as an example of a control device. The conveying rollers 130 are also linked to the motor M. While the motor M is driven, the conveying rollers 130 rotate continuously.

The sheet-feeding roller unit RU can pivot about the rotational axis of the separating roller 123 between a contact position and a retracted position. In the contact position, the pick roller 110 contacts the sheets P loaded in the paper tray 31. In the retracted position, the pick roller 110 is retracted from the paper tray 31 at a position higher than the contact position.

An urging member (not shown) is provided for constantly urging the holder 170 in a direction from the retracted position toward the contact position.

The sensor 160 is a well-known photosensor that includes a light-emitting unit 161 and a light-receiving unit 162 disposed in confrontation with each other. The sensor 160 outputs an ON signal while nothing interferes with the light passing from the light-emitting unit 161 to the light-receiving unit 162.

The first arm 140 includes a first shaft part 141 that is rotatably supported in the main body 2, and a first light-shielding arm 142 and a first contact arm 143 that both extend radially outward from the first shaft part 141. The first arm 140 is configured to pivot about the first shaft part 141.

A spring (not shown) is also attached to a portion of the first arm 140. The spring constantly urges the first arm 140 toward the non-detection position (the position in FIGS. 2A and 3).

When the first arm 140 is in the non-detection position, a distal end 142A of the first light-shielding arm 142 is disposed between the light-emitting unit 161 and light-receiving unit 162 of the sensor 160. Further, when the first arm 140 is in this non-detection position, a distal end 143A of the first contact arm 143 is disposed in a position for contacting a sheet P that has been conveyed to a position corresponding to the bottom edge of the sloped part 121. That is, the distal end 143A of the first contact arm 143 is positioned between the separating roller 123 of the separator 120 and the pick roller 110. When a sheet P conveyed by the pick roller 110 contacts the distal end 143A of the first contact arm 143, the first arm 140 pivots counterclockwise in FIG. 2A to a detection position. In the detection position, the distal end 142A of the first light-shielding arm 142 is retracted from the region between the light-emitting unit 161 and light-receiving unit 162.

The second arm 150 includes a second pivot part 151 rotatably supported on the roller shaft 124, and a second light-shielding arm 152 and a second contact arm 153 that both extend radially outward from the second pivot part 151. The second arm 150 is capable of pivoting about the second pivot part 151.

A spring (not shown) is also attached to a portion of the second arm 150. The spring constantly urges the second arm 150 toward its non-detection position (see FIGS. 2A and 3).

When the second arm 150 is in the non-detection position, a distal end 152A of the second light-shielding arm 152 is disposed between the light-emitting unit 161 and light-receiving unit 162 of the sensor 160. Further, when the second arm 150 is in its non-detection position, a distal end 153A of the second contact arm 153 is disposed in a position for contacting a sheet P conveyed to a position downstream of the separating roller 123 in the conveying direction of the sheet P. When a sheet P passing between the separating roller 123 and separating pad 122 contacts the second arm 150, the second arm 150 pivots counterclockwise in FIG. 2A to its detection position. In this detection position, the distal end 152A of the second light-shielding arm 152 is retracted from the region between the light-emitting unit 161 and light-receiving unit 162.

In the embodiment, a distance L1 from the distal end 143A of the first contact arm 143 on the sheet-conveying path to the distal end 153A of the second contact arm 153 on the sheet-conveying path is greater than a distance L2 from the leading edge of the sheets P loaded on the loading surface 31A to the distal end 143A of the first contact arm 143 on the sheet-conveying path.

When both the first arm 140 and second arm 150 are in their detection positions, the sensor 160 outputs an ON signal (serving as an example of a second signal) to the controller 180 since the first light-shielding arm 142 and second light-shielding arm 152 are retracted from the region between the light-emitting unit 161 and light-receiving unit 162. When at least one of the first arm 140 and second arm 150 is in its non-detection position, the sensor 160 outputs an OFF signal (serving as an example of a first signal) to the controller 180 since at least one of the first light-shielding arm 142 and second light-shielding arm 152 is positioned between the light-emitting unit 161 and light-receiving unit 162.

The controller 180 shown in FIG. 2A includes a CPU, RAM, ROM, and the like (not shown) and is configured to control the motor M and clutch CL according to a preset program and the like. When the laser printer 1 receives a print job, the controller 180 drives the motor M and controls the pick roller 110 and separating roller 123 by switching the clutch CL on and off based on signals received from the sensor 160. Thus, the pick roller 110 and separating roller 123 are driven when the controller 180 switches the clutch CL on and are halted when the controller 180 switches the clutch CL off.

More specifically, when a print job is received by the laser printer 1, the controller 180 performs a first sheet-supply control process for conveying a first sheet P. Subsequently, the controller 180 executes a second sheet-supply control process (serving as an example of a sheet-supply control process) for conveying a second sheet P, and a first sheet-spacing control process for conveying a third and subsequent sheets P with uniform gaps formed between the trailing edge of a preceding sheet and the leading edge of a succeeding sheet.

When the timing arrives for feeding the first sheet P in the first sheet-supply control process, the controller 180 drives the pick roller 110 by switching on the clutch CL. Once the leading edge of this sheet P arrives at the second arm 150, the signal that the sensor 160 inputs into the controller 180 changes from OFF to ON. From the moment the inputted signal changes to ON, the controller 180 waits for a second prescribed period of time Tf to elapse while leaving the clutch CL on, and subsequently halts the pick roller 110 by switching the clutch CL off.

The second prescribed period of time Tf should be set to a length of time sufficient for allowing the leading edge of the sheet P passing over the separating roller 123 to arrive at the conveying rollers 130.

In the second sheet-supply control process, the controller 180 waits for a sufficient amount of time to elapse after halting the pick roller 110 in the first sheet-supply control process in order to allow the trailing edge of the first sheet P conveyed by the conveying rollers 130 to separate from the separating roller 123 and to allow a necessary gap to be formed between this trailing edge and the leading edge of the second sheet P. Once this period of time has elapsed, the controller 180 switches the clutch CL back on to drive the pick roller 110 for the second prescribed period of time Tf, enabling the leading edge of the second sheet P to arrive at the conveying rollers 130. Subsequently, the controller 180 halts the pick roller 110 by switching the clutch CL off.

In the first sheet-spacing control process, the controller 180 waits until the signal inputted from the sensor 160 switches from ON to OFF due to the trailing edge of the preceding sheet P passing over the first arm 140 or second arm 150. At this time, the controller 180 begins driving the pick roller 110 to convey a succeeding sheet P and monitors changes in the signal from the sensor 160 in order to identify the position of the leading edge of the succeeding sheet P.

Figure 8A:
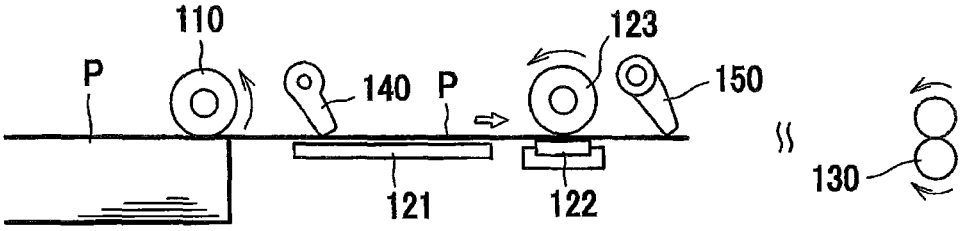
FIGS. 8A-9C are explanatory diagrams showing operations of the sheet-conveying apparatus during the single-feed.
Figure 10A:
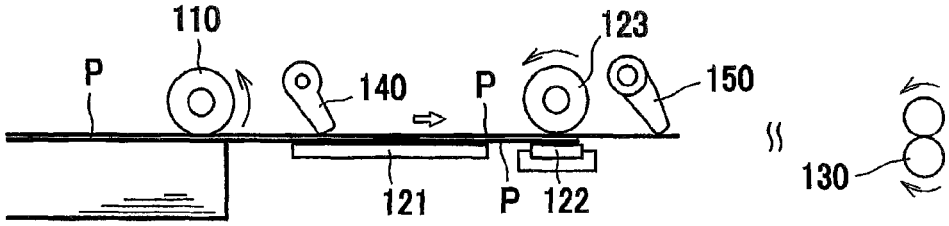
FIGS. 10A-10E are explanatory diagrams showing operations of the sheet-conveying apparatus during the double-feed with the small gap between the sheets.
Figure 11A:
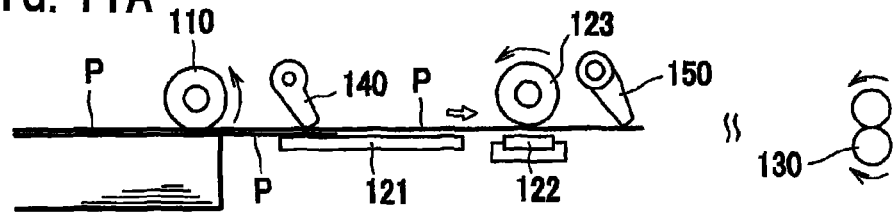
FIGS. 11A-11E are explanatory diagrams showing operations of the sheet-conveying apparatus during the double-feed with the large gap between the sheets.

More specifically, two cases may arise in the sheet-feeding device 3 of the preferred embodiment when the controller 180 drives the pick roller 110 to convey sheets P from the loading surface 31A. In the first case, the pick roller 110 conveys a single sheet P, as illustrated in FIG. 8A. In the second case, the pick roller 110 conveys a plurality of overlapped sheets P simultaneously, as illustrated in FIGS. 10A and 11A.

When the pick roller 110 conveys a plurality of sheets P simultaneously, one of two cases may arise. In the first case, the sheets P may reach the separating roller 123 and separating pad 122 in their overlapped state, as shown in FIG. 10A. In this case, the separating roller 123 and separating pad 122 separate the sheets P, with one sheet P being conveyed onward and the other(s) remaining at the separating roller 123 and separating pad 122. In this case, the leading edge of the succeeding sheet P has reached the position of the separating roller 123. In the second case, the sheets P separate at the sloped part 121 so that the leading edge of the succeeding sheet P reaches only a position between the first arm 140 and the separating roller 123, as illustrated in FIG. 11A.

In the following description, the term "single-feed" will be used to denote the case shown in FIG. 8A in which a single sheet P is conveyed by the pick roller 110. Further, the term "double-feed (small gap between sheets)" will be used to denote the case shown in FIG. 10A in which the pick roller 110 conveys two or more sheets P simultaneously, with the leading edge of the second (succeeding) sheet P reaching the separating roller 123. The term "double-feed (large gap between sheets)" will be used to denote the case shown in FIG. 11A in which the pick roller 110 conveys two or more sheets simultaneously, with the leading edge of the second (succeeding) sheet P not reaching the separating roller 123.

As described above, the timing at which the sensor 160 changes from OFF to ON when a succeeding sheet P is being conveyed depends on the position of the leading edge of the sheet P prior to conveyance.

Therefore, while the pick roller 110 remains halted, the controller 180 waits until the signal inputted from the sensor 160 changes from ON to OFF. Once the signal inputted from the sensor 160 changes to OFF, the controller 180 drives the pick roller 110 through the first sheet-spacing control process and determines whether an elapsed time $T_1$ until the signal from the sensor 160 changes back to ON exceeds a first prescribed period of time TB. The controller 180 executes different control processes based on the results of this determination.

Further, if the elapsed time $T_1$ after starting to drive the pick roller 110 and until the signal outputted from the sensor 160 switches from OFF to ON is shorter than the first prescribed period of time TB, then the controller 180 halts the pick roller 110 and determines whether the signal outputted from the sensor 160 changes by the time the first prescribed period of time TB has elapsed. The controller 180 executes different control processes based on the results of this determination.

Next, detailed control operations of the controller 180 beginning from the second sheet-supply control process will be described with reference to FIGS. 4 through 6.

Figure 4:
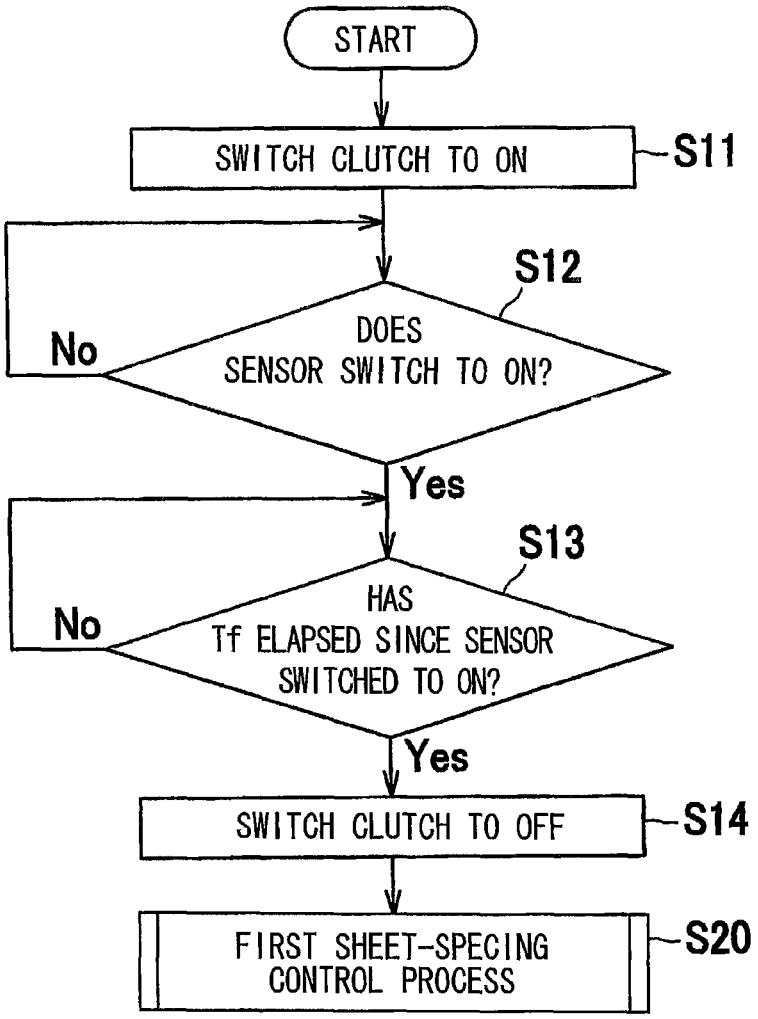
FIG. 4 is a flowchart illustrating steps in a second sheet-supply control process executed by a control device of the sheet-conveying apparatus.

FIG. 4 shows the first and second sheet-supply control processes executed by the controller 180. In S11 of FIG. 4, the controller 180 switches the clutch CL to ON in order to drive the pick roller 110. In S12 the controller 180 determines whether the signal inputted from the sensor 160 has switched from OFF to ON. If the signal has not switched to ON at this time (S12: NO), the controller 180 continues to wait until the signal inputted from the sensor 160 switches to ON, indicating that the leading edge of a sheet P has arrived at the second arm 150.

When the signal inputted from the sensor 160 has switched to ON (S12: YES), in S13 the controller 180 determines whether the second prescribed period of time Tf has elapsed since the signal switched to ON in S12. If the second prescribed period of time Tf has not elapsed at this time (S13: NO), the controller 180 continues to wait until the second prescribed period of time Tf has elapsed.

Once the second prescribed period of time Tf has elapsed (S13: YES), in S14 the controller 180 switches the clutch CL to OFF in order to halt the pick roller 110. Subsequently, in S20 the controller 180 executes the first sheet-spacing control process.

Figure 5:
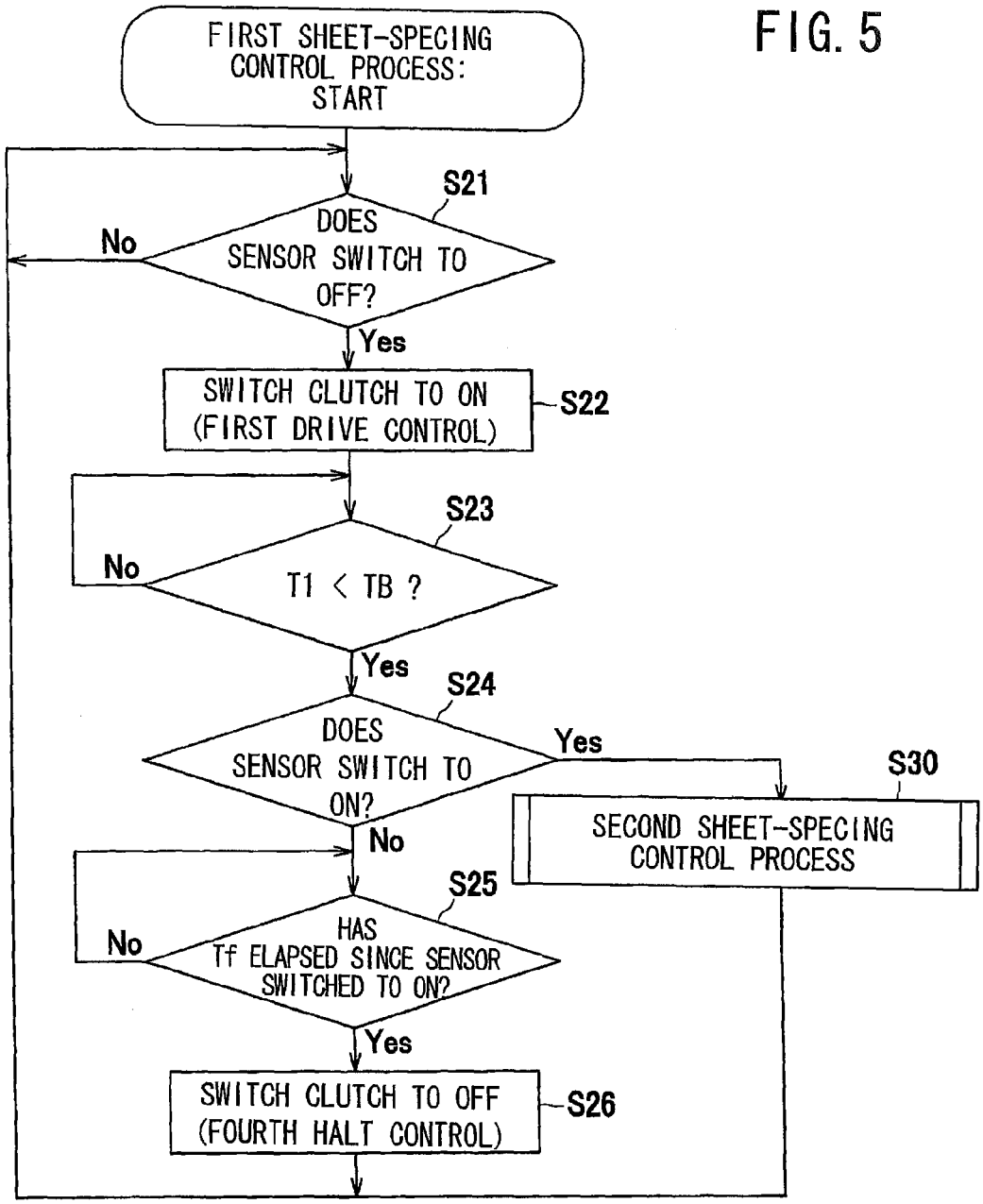
FIG. 5 is a flowchart illustrating steps in a first sheet-spacing control process executed by the control device.

FIG. 5 shows the first sheet-spacing control process executed by the controller 180. In S21 of FIG. 5, the controller 180 determines whether the signal inputted from the sensor 160 has switched from ON to OFF. If the signal from the sensor 160 has not switched to OFF at this time (S21: NO), the controller 180 continues to wait until the signal has switched to OFF.

Once the signal inputted from the sensor 160 has switched to OFF (S21: YES), in S22 the controller 180 executes a first drive control process for switching the clutch CL to ON to drive the pick roller 110.

After starting to drive the pick roller 110 through the first drive control process in S22, in S23 the controller 180 determines whether the signal inputted from the sensor 160 has switched from OFF to ON. If the inputted signal has not switched to ON at this time (S23: NO), the controller 180 continues to wait until the signal switches to ON.

Once the signal inputted from the sensor 160 has switched from OFF to ON (S23: YES), in S24 the controller 180 determines whether the elapsed time $T_1$ after the controller 180 began driving the pick roller 110 in S22 and until the signal inputted from the sensor 160 switched to ON is shorter than the first prescribed period of time TB.

Note that the first prescribed period of time TB is set no greater than the length of time required for the trailing edge of the sheet P to move from the position of the first arm 140 to the position of the second arm 150.

If the controller 180 determines in S24 that the elapsed time $T_1$ is greater than or equal to the first prescribed period of time TB (S24: NO), in S25 the controller 180 determines whether the second prescribed period of time Tf has elapsed since the signal inputted from the sensor 160 switched from OFF to ON in S23. If the second prescribed period of time Tf has not elapsed at this time (S25: NO), the controller 180 continues to wait until the second prescribed period of time Tf has elapsed.

Once the second prescribed period of time Tf has elapsed (S25: YES), in S26 the controller 180 executes a fourth halt control process for switching the clutch CL to OFF to halt the pick roller 110. After the process in S26, the controller 180 returns to S21 and resumes the sheet-spacing control process.

When the controller 180 determines in S24 that the elapsed time $T_1$ is shorter than the first prescribed period of time TB (S24: YES), in S30 the controller 180 executes a second sheet-spacing control process.

Figure 6:
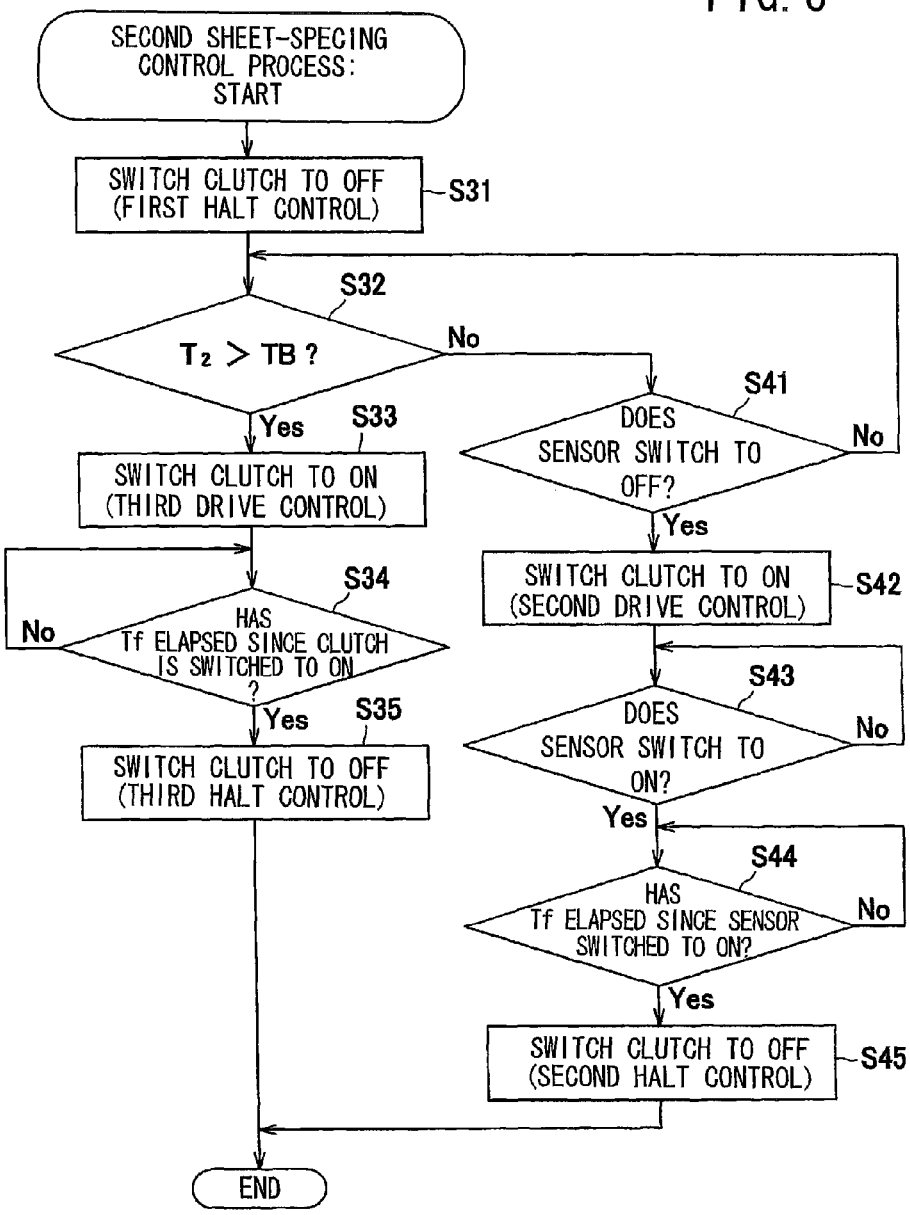
FIG. 6 is a flowchart illustrating steps in a second sheet-spacing control process executed by the control device.

FIG. 6 shows the second sheet-spacing control process executed by the controller 180. In S31 of FIG. 6, the controller 180 executes a first halt control process for switching the clutch CL to OFF to halt the pick roller 110. In S32 the controller 180 determines whether an elapsed time $T_2$ after the start of driving the pick roller 110 in S22 of the sheet-spacing control process is longer than the first prescribed period of time TB. If the elapsed time $T_2$ is less than or equal to the first prescribed period of time TB (S32: NO), in S41 the controller 180 determines whether the signal inputted from the sensor 160 has switched from ON to OFF. If the inputted signal has not switched to OFF at this time (S41: NO), the controller 180 returns to S32 and continues the control process.

If the controller 180 determines that the signal inputted from the sensor 160 has switched to OFF in S41, i.e., when the signal inputted from the sensor 160 has switched from ON to OFF within the first prescribed period of time TB following the start of driving the pick roller 110 in S22 (S41: YES), in S42 the controller 180 executes a second drive control process for switching the clutch CL to ON to drive the pick roller 110.

After the controller 180 begins driving the pick roller 110 in S42, in S43 the controller 180 determines whether the signal inputted from the sensor 160 has switched from OFF to ON. If the inputted signal has not switched to ON at this time (S43: NO), the controller 180 waits until the inputted signal has switched to ON.

If the controller 180 determines in S43 that the signal inputted from the sensor 160 has switched to ON (S43: YES), in S44 the controller 180 determines whether the second prescribed period of time Tf has elapsed since the signal inputted from the sensor 160 switched to ON in S43. If the controller 180 determines that the second prescribed period of time Tf has not yet elapsed at this time (S44: NO), the controller 180 waits until the second prescribed period of time Tf has elapsed.

Once the controller 180 determines that the second prescribed period of time Tf has elapsed (S44: YES), in S45 the controller 180 executes a second halt control process for switching the clutch CL to OFF to halt the pick roller 110.

If the controller 180 determines in S32 that the elapsed time $T_2$ after driving of the pick roller 110 was started in S22 exceeds the first prescribed period of time TB, i.e., when the signal inputted from the sensor 160 did not switch from ON to OFF within the first prescribed period of time TB after the drive of the pick roller 110 was started in S22 (S32: YES), in S33 the controller 180 executes a third drive control process for switching the clutch CL to ON to drive the pick roller 110.

After the controller 180 begins driving the pick roller 110 in S33, in S34 the controller 180 determines whether the second prescribed period of time Tf has elapsed. If the second prescribed period of time Tf has not elapsed at this time (S34: NO), the controller 180 waits until the second prescribed period of time Tf has elapsed.

When the controller 180 determines in S34 that the second prescribed period of time Tf has elapsed (S34: YES), in S35 the controller 180 executes a third halt control process for switching the clutch CL to OFF to halt the pick roller 110.

After completing the process in either step S35 or step S45, the controller 180 ends the second sheet-spacing control process and returns to S21 to continue the sheet-spacing control process.

Next, the operations of the sheet-feeding device 3 having the above structure will be described for a printing operation.

First, the operations performed by the sheet-feeding device 3 during a single-feed will be described with reference to FIGS. 7A, 8, and 9.

Figure 7A:
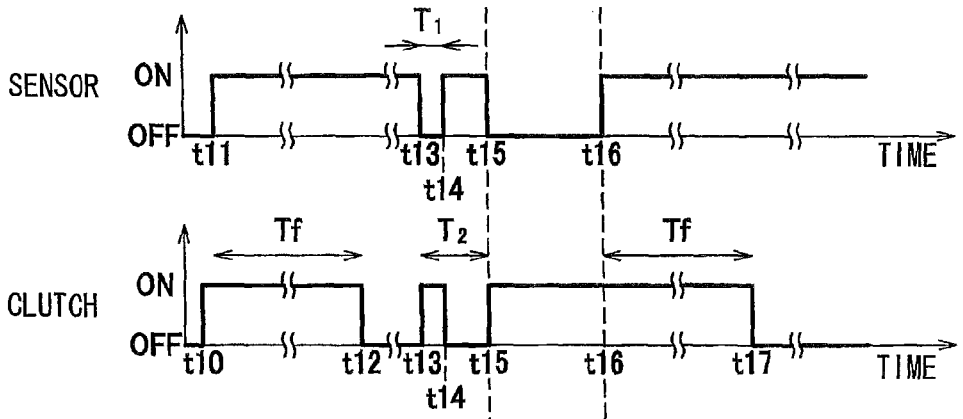
FIG. 7A is a timing chart showing a relationship between on/off of sensor and on/off of clutch during a single-feed.
Figure 8B:
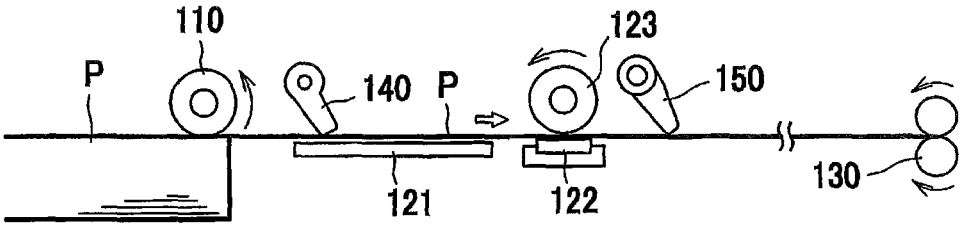

When executing the second sheet-supply control process, the controller 180 drives the pick roller 110 to convey a sheet P (timing t10 in FIG. 7A). When the leading edge of the sheet P reaches the second arm 150, as shown in FIG. 8A, both the first arm 140 and second arm 150 are in their detection position, and the sensor 160 outputs an ON signal (timing t11). After the signal outputted by the sensor 160 changes to ON, the controller 180 continues driving the pick roller 110 until the second prescribed period of time Tf has elapsed from the point the outputted signal changed to ON, as shown in FIG. 8B. The controller 180 halts the pick roller 110 after the leading edge of the sheet P arrives at the conveying rollers 130 (timing t12).

Figure 8C:
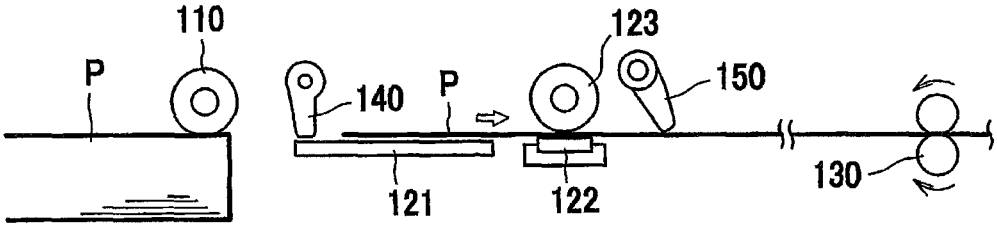

After the pick roller 110 is halted, the conveying rollers 130 pull and convey the sheet P until the trailing edge of the sheet P separates from the first arm 140, as shown in FIG. 8C. At this point, the first arm 140 moves to its non-detection position and the signal outputted from the sensor 160 changes to OFF (timing t13).

Figure 8D:
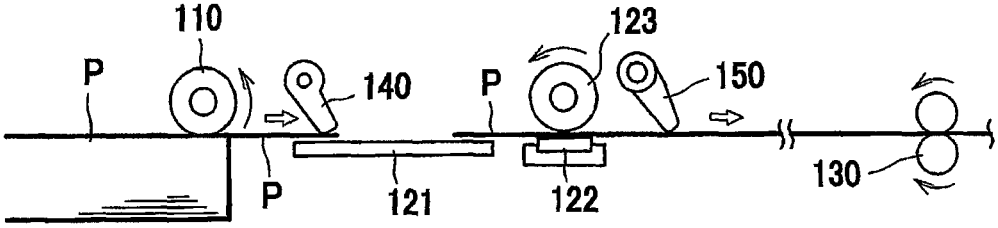

When the signal from the sensor 160 changes to OFF, the controller 180 executes the first drive control process for driving the pick roller 110 (timing t13) in order to convey the succeeding sheet P until the leading edge of the succeeding sheet P arrives at the first arm 140, as illustrated in FIG. 8D. Since the distance L1 from the position of the first arm 140 to the position of the second arm 150 on the conveying path is greater than the distance L2 from the leading edges of sheets P stacked on the loading surface 31A to the position of the first arm 140 on the conveying path, the trailing edge of the preceding sheet P has not yet separated from the second arm 150. Hence, both the first arm 140 and second arm 150 are in their detection position, and the signal inputted from the sensor 160 is ON (timing t14).

Figure 9A:
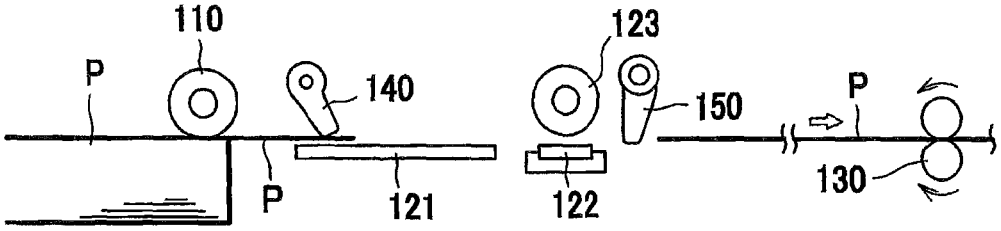

Further, since the elapsed time $T_1$ from the moment the signal inputted from the sensor 160 changed to OFF until the inputted signal changed to ON (t13-t14) is shorter than the first prescribed period of time TB in the case of a single-feed, the controller 180 executes the fourth halt control process to halt the pick roller 110 (timing t14). After the pick roller 110 is halted, the conveying rollers 130 pull and convey the sheet P. Once the trailing edge of the preceding sheet P separates from the second arm 150, as illustrated in FIG. 9A, the second arm 150 moves to its non-detection position and the signal inputted from the sensor 160 changes to OFF (timing t15). In the meantime, the succeeding sheet P remains halted with its leading edge positioned at the first arm 140.

Figure 9B:
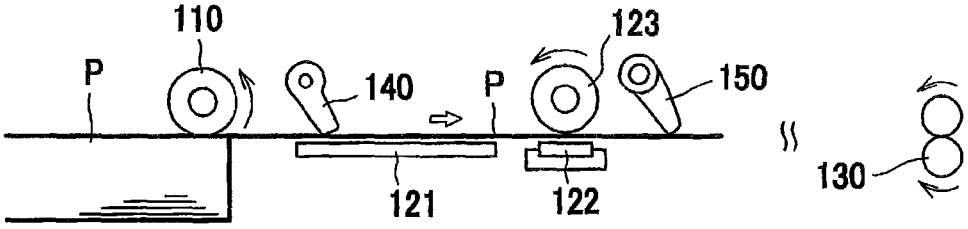

Since the elapsed time $T_2$ from the moment the clutch CL was turned ON to the moment the sensor 160 switched back to OFF (t13-t15) is less than or equal to the first prescribed period of time TB in the case of a single-feed, the controller 180 executes the second drive control process for driving the pick roller 110. When the leading edge of the sheet P arrives at the second arm 150, as shown in FIG. 9B, the second arm 150 moves to its detection position and the signal inputted from the sensor 160 changes to ON (timing t16).

Figure 9C:
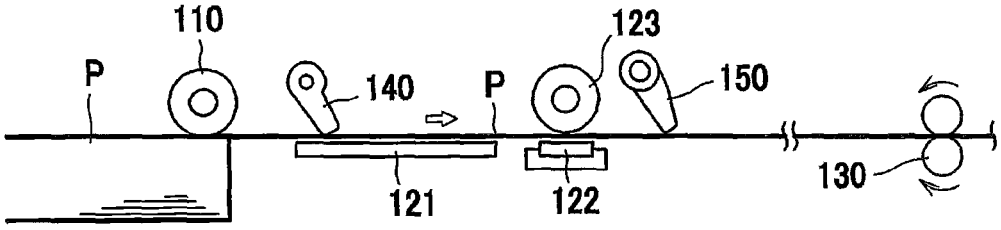

After the signal inputted from the sensor 160 changes to ON, the controller 180 continues driving the pick roller 110 during the second prescribed period of time Tf until the leading edge of the sheet P arrives at the conveying rollers 130, as shown in FIG. 9C, and subsequently executes the second halt control process to halt the pick roller 110 (timing t17).

Figure 7B:
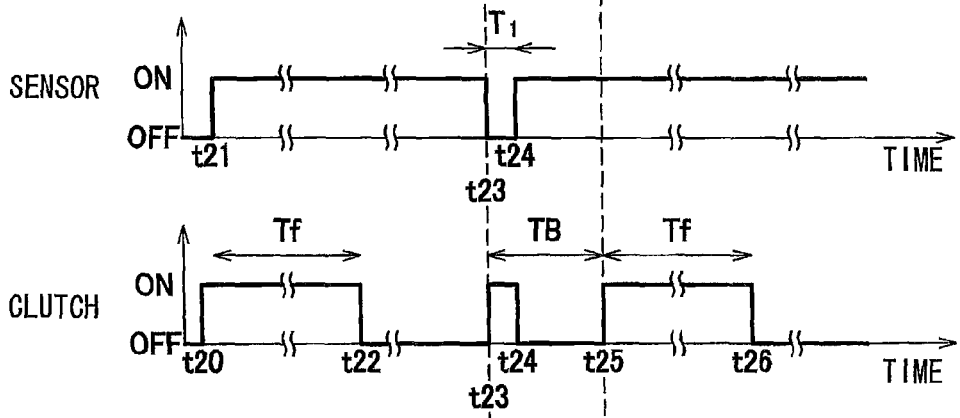
FIG. 7B is a timing chart showing a relationship between on/off of sensor and on/off of clutch during a double-feed with a small gap between sheets.

Next, the operations of the sheet-feeding device 3 performed in the case of a double-feed (small gap between sheets) will be described with reference to FIGS. 7B and 10.

Figure 10B:
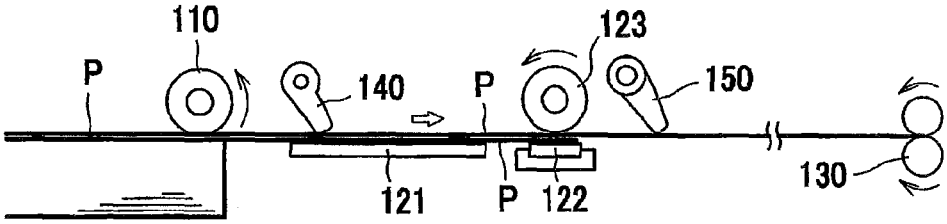

When executing the second sheet-supply control process, the controller 180 drives the pick roller 110 to convey the sheet P, as shown in FIG. 10A (timing t20). Once the leading edge of a sheet P arrives at the second arm 150, both the first arm 140 and second arm 150 are in their detection position and the signal outputted from the sensor 160 is ON (timing t21). After the output signal from the sensor 160 changes to ON, the controller 180 continues to drive the pick roller 110 until the second prescribed period of time Tf has elapsed since the output signal from the sensor 160 changed to ON, allowing the leading edge of the sheet P to reach the conveying rollers 130, and the controller 180 halts the pick roller 110, as shown in FIG. 10B (timing t22).

Figure 10C:
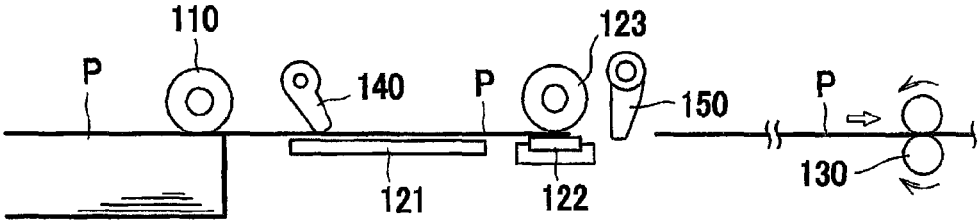

After the pick roller 110 is halted, the conveying rollers 130 continue to pull and convey the sheet P until the trailing edge of the sheet P separates from the first arm 140. However, since the leading edge of the succeeding sheet P remains in a position at the separating roller 123, the first arm 140 remains in the detection position. After the trailing edge of the preceding sheet P separates from the second arm 150, as shown in FIG. 10C, the second arm 150 moves to its non-detection position and the signal from the sensor 160 changes to OFF (timing t23).

Figure 10D:
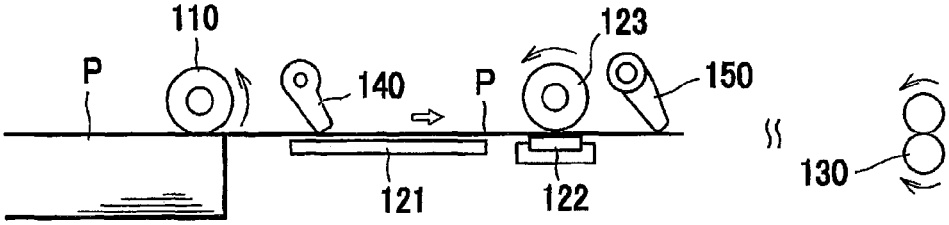

At this time, the controller 180 executes the first drive control process to begin rotating the pick roller 110 (timing t23). As the pick roller 110 rotates, the leading edge of the succeeding sheet P arrives at the second arm 150, as shown in FIG. 10D, moving the second arm 150 to the detection position so that the signal inputted from the sensor 160 changes to ON (timing t24). Since the elapsed time $T_1$ from the point that the signal from the sensor 160 changes from ON to OFF to the point the signal changes back to ON (t23-t24) is shorter than the first prescribed period of time TB in the case of a double-feed (small gap between sheets), the controller 180 executes the first halt control process to halt the pick roller 110 (timing t24). Since the leading edge of the succeeding sheet P is stopped in a position at the second arm 150, the signal outputted from the sensor 160 will remain ON, even after the first prescribed period of time TB has elapsed.

Figure 10E:
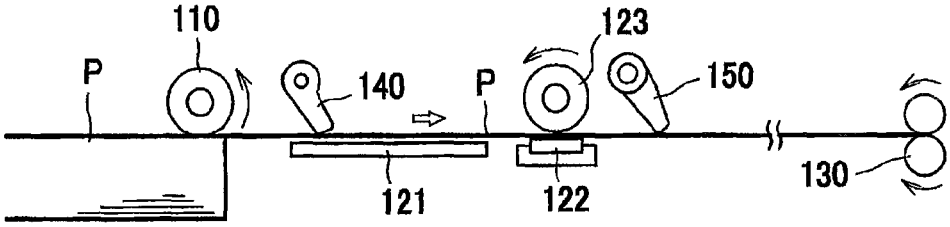

Therefore, the controller 180 executes the third drive control process to rotate the pick roller 110 (timing t25). After the controller 180 executes the third drive control process and the pick roller 110 is allowed to rotate for the second prescribed period of time Tf, the leading edge of the succeeding sheet P arrives at the conveying rollers 130, as shown in FIG. 10E. At this time, the controller 180 executes the third halt control process to halt the pick roller 110 (timing t26).

Figure 7C:
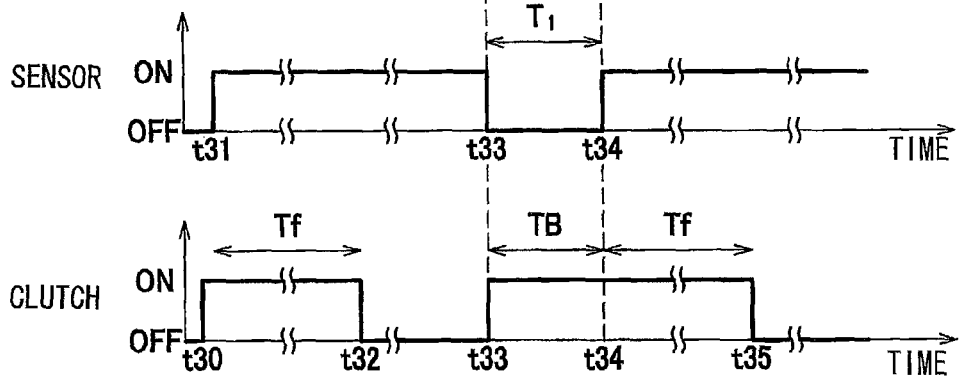
FIG. 7C is a timing chart showing a relationship between on/off of sensor and on/off of clutch during a double-feed with a large gap between sheets.

Next, the operations performed by the sheet-feeding device 3 in the case of a double-feed (large gap between sheets) will be described with reference to FIGS. 7C and 11.

Figure 11B:
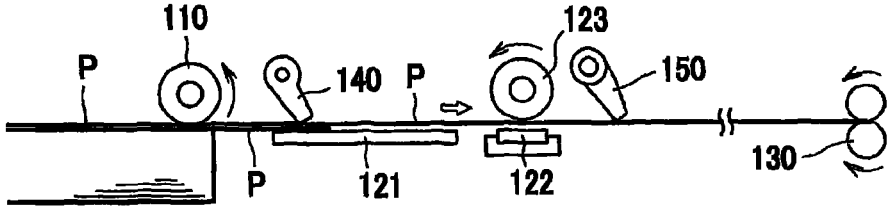

After executing the second sheet-supply control process, the controller 180 drives the pick roller 110 to convey a sheet P, as illustrated in FIG. 11A (timing t30). When the leading edge of the sheet P arrives at the second arm 150, both the first arm 140 and second arm 150 are in their detection position and, hence, the signal outputted from the sensor 160 is ON (timing t31). After the signal outputted from the sensor 160 changes to ON, the controller 180 continues to drive the pick roller 110 until the second prescribed period of time Tf has elapsed since the moment the outputted signal changed to ON has elapsed, and halts the pick roller 110 after the leading edge of the sheet P has arrived at the conveying rollers 130, as shown in FIG. 11B (timing t32).

Figure 11C:
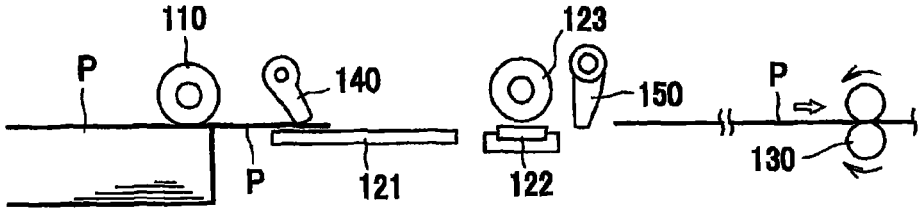

After the controller 180 halts the pick roller 110, the conveying rollers 130 continue to pull and convey the preceding sheet P until the trailing edge of the sheet P separates from the first arm 140. However, since the leading edge of the succeeding sheet P has arrived at the first arm 140, the first arm 140 remains in its detection position. When the trailing edge of the preceding sheet P separates from the second arm 150, as shown in FIG. 11C, the second arm 150 moves to its non-detection position and the sensor 160 outputs an OFF signal (timing t33).

Figure 11D:
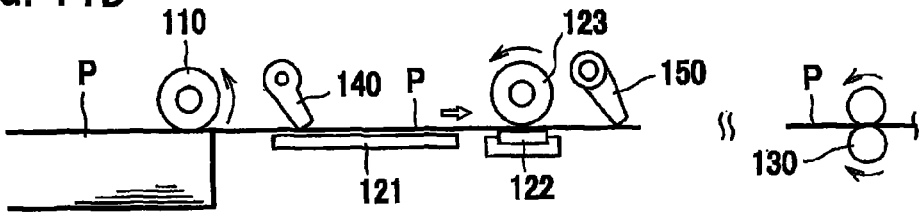

At this time, the controller 180 executes the first drive control process to rotate the pick roller 110 (timing t33). As the pick roller 110 rotates, the leading edge of the succeeding sheet P arrives at the second arm 150, as shown in FIG. 11D, thereby moving the second arm 150 into its detection position and changing the signal inputted from the sensor 160 to ON (timing t34). Since this example is for a double-feed (large gap between sheets), the elapsed time $T_1$ from the moment the signal from the sensor 160 was changed to OFF until the signal changes back to ON (t33-t34) is longer than the first prescribed period of time TB. Accordingly, the controller 180 continues to drive the pick roller 110 for the second prescribed period of time Tf after the first prescribed period of time TB has elapsed.

Figure 11E:
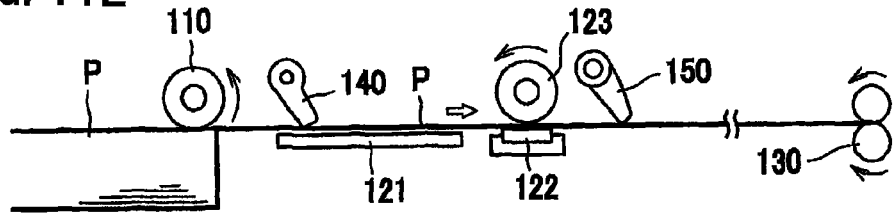

By continuing to drive the pick roller 110 while waiting until the second prescribed period of time Tf has elapsed, the controller 180 enables the leading edge of the succeeding sheet P to arrive at the conveying rollers 130, as illustrated in FIG. 11E. At this time, the controller 180 executes the fourth halt control process to halt the pick roller 110 (timing t35).

Through the operations described above, the sheet-feeding device 3 can initiate conveyance of the succeeding sheet P at approximately the same timing (t16, t25, t34) for the various cases of sheet feeding described above. Accordingly, the operations of the sheet-feeding device 3 can reduce variations in gaps formed between consecutively conveyed sheets P.

Further, the controller 180 can control the operations of the sheet-feeding device 3 based on the signal outputted from a single sensor 160. Accordingly, this arrangement enables the controller 180 to implement a control process for reducing variations in the gaps formed between consecutively conveyed sheets P, while minimizing manufacturing costs.

While the invention has been described in detail with reference to the embodiment thereof, it would be apparent to those skilled in the art that various changes and modifications may be made therein without departing from the spirit of the invention.

In the above-described embodiment, the controller 180 determines the timing for switching the clutch CL on and off based on the ON/OFF signal inputted from the sensor 160, but the present invention is not limited to this method. Here, a variation of the first sheet-spacing control process executed by the controller 180 will be described.

Figure 12:
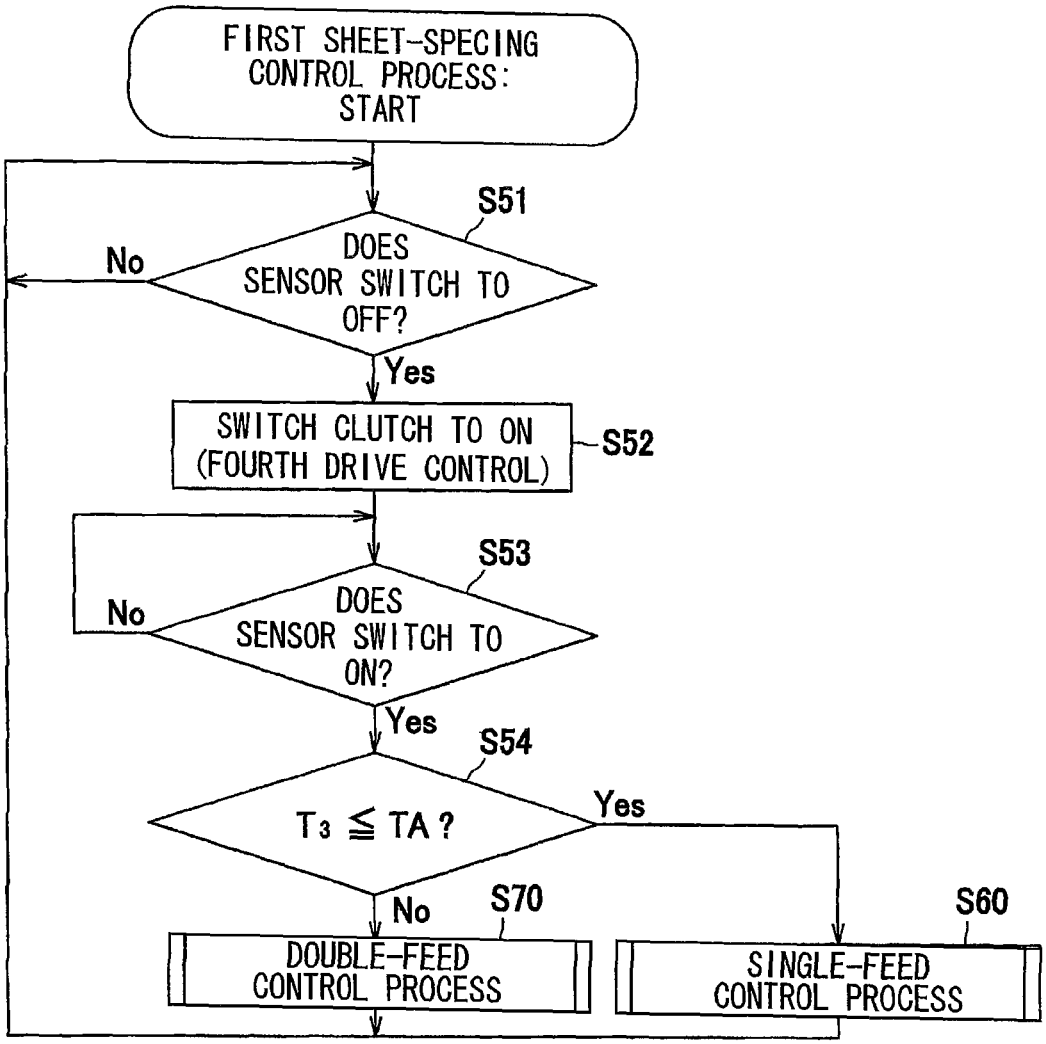
FIG. 12 is a flowchart illustrating steps in a first sheet-spacing control process in a first modification of the embodiment.

FIG. 12 shows the first sheet-spacing control process executed by the controller 180 according to the variation. In S51 of FIG. 12, the controller 180 determines whether the signal inputted from the sensor 160 has switched from ON to OFF. If the controller 180 determines that the inputted signal has not switched to OFF at this time (S51: NO), the controller 180 continues to wait until the inputted signal has switched to OFF.

Once the controller 180 determines that the signal inputted from the sensor 160 has switched to OFF (S51: YES), in S52 the controller 180 executes a fourth drive control process for driving the pick roller 110 by switching the clutch CL to ON.

After starting to drive the pick roller 110 in S52, in S53 the controller 180 determines whether the signal inputted from the sensor 160 has switched from OFF to ON. If the controller 180 determines that the inputted signal has not switched to ON at this time (S53: NO), the controller 180 continues to wait until the signal changes to ON.

Once the signal inputted from the sensor 160 has switched to ON (S53: YES), in S54 the controller 180 determines whether an elapsed time $T_3$ from the moment the signal inputted from the sensor 160 was determined to switch from OFF to ON in S12 after the controller 180 began driving the pick roller 110 in S11 according to the second sheet-supply control process and until the signal from the sensor 160 changes back to OFF is no greater than a third prescribed period of time TA.

Here, the third prescribed period of time TA will be described. As shown in FIG. 1, the sheet-feeding device 3 is also provided with a post-registration sensor 34. The post-registration sensor 34 is disposed downstream of the registration rollers 33 in the conveying direction of the sheets P for detecting passage of the sheets P. The post-registration sensor 34 together with the controller 180 serves as an example of a detector. Through the controller 180 and post-registration sensor 34, the sheet-feeding device 3 detects a paper length conveyance time from the moment the leading edge of the sheet P passes a certain point (the post-registration sensor 34 in this case) until the trailing edge of the sheet P passes the same point. The paper length conveyance time serves as an example of sheet length conveyance time. The third prescribed period of time TA is set to a length of time longer than the length of time resulting from subtracting a conveyance time required for conveying an edge of a sheet P from the first arm 140 to the second arm 150 from the paper length conveyance time.

When the controller 180 determines in S54 that the elapsed time $T_3$ is no longer than the third prescribed period of time TA (S54: YES), in S60 the controller 180 executes a single-feed control process. However, if the controller 180 determines that the elapsed time $T_3$ is longer than the third prescribed period of time TA (S54: NO), in S70 the controller 180 executes a double-feed control process.

Figure 13:
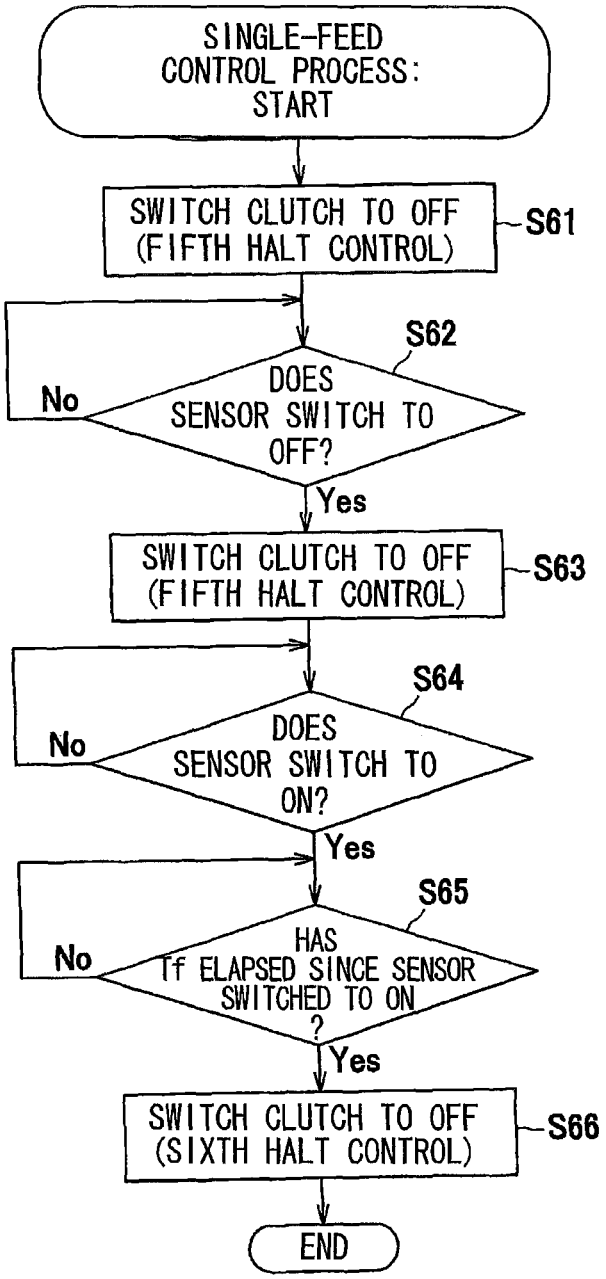
FIG. 13 is a flowchart illustrating steps in a single-feed control process in the first sheet-spacing control process in the first modification.

FIG. 13 shows the single-feed control process executed by the controller 180. In S61 of FIG. 13, the controller 180 executes a fifth halt control process for switching the clutch CL to OFF to halt the pick roller 110. In S62 the controller 180 determines whether the signal inputted from the sensor 160 has switched from ON to OFF. If the inputted signal has not switched to OFF at this time (S62: NO), the controller 180 waits until the signal inputted from the sensor 160 changes to OFF.

If the controller 180 determines that the signal inputted from the sensor 160 has changed to OFF (S62: YES), in S63 the controller 180 executes a fifth drive control process for switching the clutch CL to ON to drive the pick roller 110.

After the controller 180 begins driving the pick roller 110 in S63, in S64 the controller 180 determines whether the signal inputted from the sensor 160 has switched from OFF to ON. If the inputted signal has not changed to ON at this time (S64: NO), the controller 180 waits until the inputted signal has switched to ON.

If the controller 180 determines in S64 that the signal inputted from the sensor 160 has switched to ON (S64: YES), in S65 the controller 180 determines whether the second prescribed period of time Tf has elapsed since the signal inputted from the sensor 160 changed to ON in S64. If the controller 180 determines that the second prescribed period of time Tf has not yet elapsed at this time (S65: NO), the controller 180 waits until the second prescribed period of time Tf has elapsed.

Once the controller 180 determines that the second prescribed period of time Tf has elapsed (S65: YES), in S66 the controller 180 executes a sixth halt control process for switching the clutch CL to OFF to halt the pick roller 110.

Upon completing the sixth halt control process in S66, the controller 180 returns to S51 and resumes the sheet-spacing control process.

Figure 14:
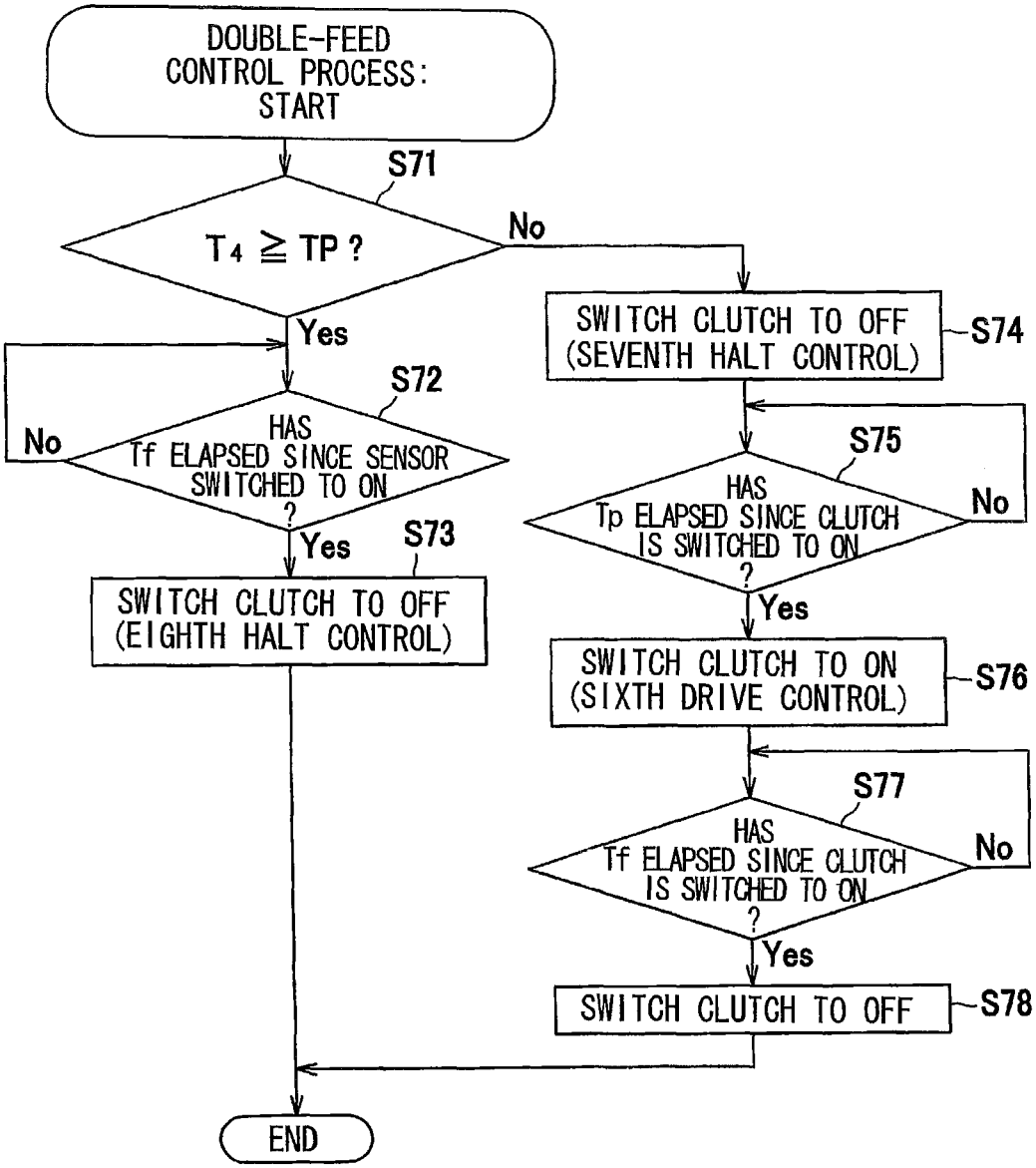
FIG. 14 is a flowchart illustrating steps in a double-feed control process in the first sheet-spacing control process in the first modification.

FIG. 14 shows the double-feed control process executed by the controller 180. In S71 of FIG. 14, the controller 180 determines whether an elapsed time $T_4$ from the point that driving of the pick roller 110 was started in S52 until the signal inputted from the sensor 160 switched from OFF to ON in S53 is greater than or equal to a fourth prescribed period of time TP.

Here, the fourth prescribed period of time TP is set no greater than the length of time required for the trailing edge of the sheet P to move from a position at the first arm 140 to a position at the second arm 150.

If the controller 180 determines in S71 that the elapsed time $T_4$ is greater than or equal to the fourth prescribed period of time TP (S71: YES), in S72 the controller 180 determines whether the second prescribed period of time Tf has elapsed since the signal inputted from the sensor 160 changed to ON in S53. If the second prescribed period of time Tf has not elapsed at this time (S72: NO), the controller 180 continues to wait until the second prescribed period of time Tf has elapsed.

When the controller 180 determines in S72 that the second prescribed period of time Tf has elapsed since the signal inputted from the sensor 160 changed to ON in S53 (S72: YES), in S73 the controller 180 executes an eighth halt control process for switching the clutch CL to OFF to halt the pick roller 110.

On the other hand, if the controller 180 determines in S71 that the elapsed time $T_4$ is shorter than the fourth prescribed period of time TP (S71: NO), in S74 the controller 180 executes a seventh halt control process for switching the clutch CL to OFF to halt the pick roller 110.

After halting the pick roller 110 in S74, in S75 the controller 180 determines whether the fourth prescribed period of time TP has elapsed since driving of the pick roller 110 was started in S52. If the fourth prescribed period of time TP has not elapsed at this time (S75: NO), the controller 180 continues to wait until the fourth prescribed period of time TP has elapsed.

If the controller 180 determines in S75 that the fourth prescribed period of time TP has elapsed since driving of the pick roller 110 was started in S52 (S75: YES), in S76 the controller 180 executes a sixth drive control process for switching the clutch CL to ON to drive the pick roller 110.

In S77 the controller 180 determines whether the second prescribed period of time Tf has elapsed since the clutch CL was switched to ON in S76. If the second prescribed period of time Tf has not elapsed (S77: NO), the controller 180 continues to wait until the second prescribed period of time Tf has elapsed.

When the controller 180 determines that the second prescribed period of time Tf has elapsed (S77: YES), in S78 the controller 180 switches the clutch CL to OFF and halts the pick roller 110.

After completing the process in either step S73 or step S78, the controller 180 returns to S51 to continue the sheet-spacing control process.

Next, the operations of the sheet-feeding device 3 having the above structure will be described for a printing operation.

Figure 15A:
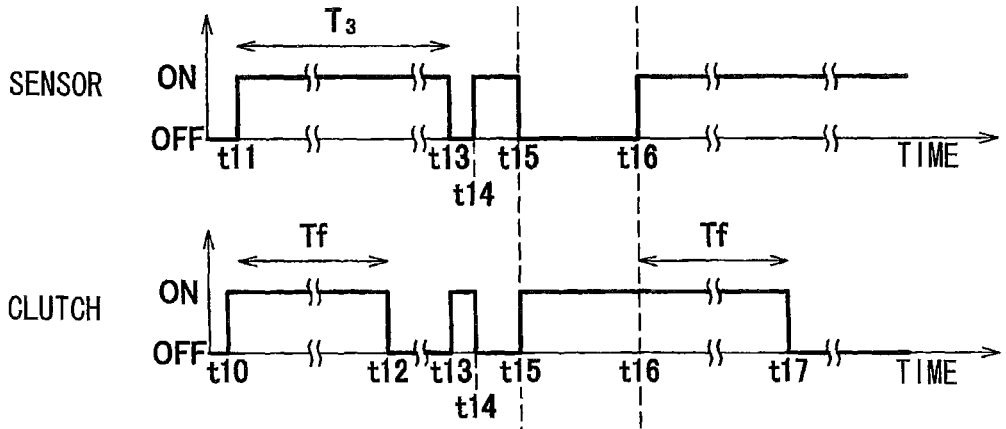
FIG. 15A is a timing chart showing a relationship between on/off of sensor and on/off of clutch during a single-feed in the first modification.

First, the operations performed by the sheet-feeding device 3 during a single-feed will be described with reference to FIGS. 15A, 8, and 9. When the controller 180 executes the sheet-spacing control process, the conveying rollers 130 pull the sheet P until the trailing edge of the sheet P separates from the first arm 140, as shown in FIG. 8C. At this point, the first arm 140 moves to its non-detection position and the signal inputted from the sensor 160 changes to OFF (timing t13).

When the signal inputted from the sensor 160 changes to OFF, the controller 180 executes the fourth drive control process for driving the pick roller 110 (timing t13) in order to convey the succeeding sheet P until the leading edge of the succeeding sheet P arrives at the first arm 140, as illustrated in FIG. 8D. Since the trailing edge of the preceding sheet P has not yet separated from the second arm 150, both the first arm 140 and second arm 150 are in their detection position, and the signal inputted from the sensor 160 is ON (timing t14).

Further, the elapsed time $T_3$ from the moment the signal inputted from the sensor 160 changed from OFF to ON after the controller 180 began driving the pick roller 110 in S11 of the second sheet-supply control process to the moment the inputted signal was determined to change from ON to OFF in S51 (t11-t13) is shorter than the third prescribed period of time TA in the case of a single-feed. Accordingly, the controller 180 executes the fifth halt control process to halt the pick roller 110 (timing t14).

After the pick roller 110 is halted, the conveying rollers 130 pull and convey the preceding sheet P. Once the trailing edge of the preceding sheet P separates from the second arm 150, as illustrated in FIG. 9A, the second arm 150 moves to its non-detection position and the signal inputted from the sensor 160 changes to OFF (timing t15). In the meantime, the succeeding sheet P remains halted with its leading edge positioned at the first arm 140.

When the controller 180 executes the fifth drive control process to drive the pick roller 110, the succeeding sheet P is conveyed (timing t15). Once the leading edge of the succeeding sheet P arrives at the second arm 150, as shown in FIG. 9B, the second arm 150 moves to the detection position and the signal inputted from the sensor 160 changes to ON (timing t16).

After the signal inputted from the sensor 160 changes to ON, the controller 180 continues to drive the pick roller 110 during the second prescribed period of time Tf until the leading edge of the sheet P arrives at the conveying rollers 130, as shown in FIG. 9C, and subsequently executes the second halt control process to halt the pick roller 110 (timing t17).

Figure 15B:
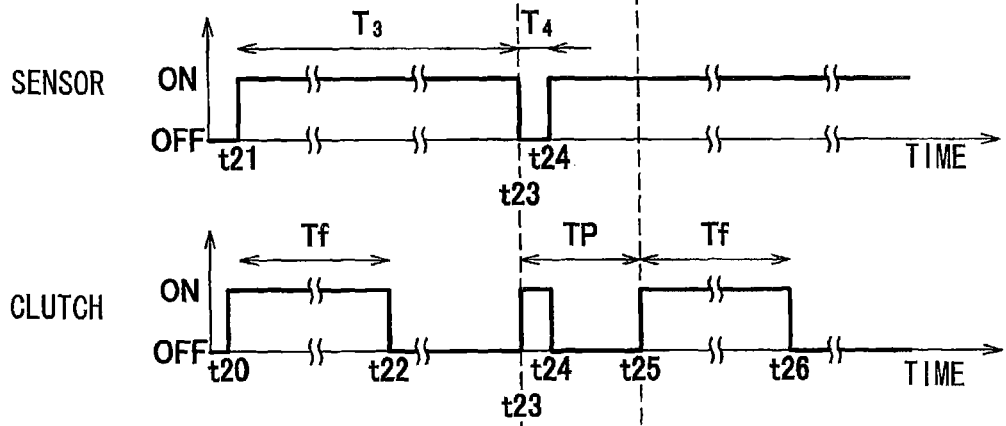
FIG. 15B is a timing chart showing a relationship between on/off of sensor and on/off of clutch during a double-feed with a small gap between sheets in the first modification.

Next, the operations of the sheet-feeding device 3 performed in the case of a double-feed (small gap between sheets) will be described with reference to FIGS. 15B and 10.

When the controller 180 executes the sheet-spacing control process, the trailing edge of the sheet P separates from the second arm 150, as shown in FIG. 10C. At this time, the second arm 150 moves to its non-detection position and the signal inputted from the sensor 160 changes to OFF (timing t23).

When the signal inputted from the sensor 160 changes to OFF, the controller 180 executes the fourth drive control process to drive the pick roller 110 (timing t23). As the pick roller 110 rotates, the leading edge of the succeeding sheet P arrives at the second arm 150, as shown in FIG. 10D. Accordingly, both the first arm 140 and second arm 150 are in their detection positions and the signal inputted from the sensor 160 changes to ON (timing t24).

Since the elapsed time $T_3$ from the moment the signal inputted from the sensor 160 changes from OFF to ON after the controller 180 began driving the pick roller 110 in the second sheet-supply control process and until the signal changes back to OFF (t21-t23) is shorter than the third prescribed period of time TA in the case of a double-feed (small gap between sheets), and since the elapsed time $T_4$ after the controller 180 began driving the pick roller 110 according to the fourth drive control process and until the signal inputted from the sensor 160 changes from OFF to ON (t23-t24) is shorter than the fourth prescribed period of time TP, the controller 180 executes the seventh halt control process to halt the pick roller 110 (timing t24). Through this process, the leading edge of the succeeding sheet P remains halted in a position at the second arm 150.

After halting the pick roller 110, the controller 180 waits until the fourth prescribed period of time TP has elapsed after starting the pick roller 110 according to the fourth drive control process, and subsequently executes the sixth drive control process for driving the pick roller 110 (timing t25). Thereafter, the controller 180 continues to drive the pick roller 110 during the second prescribed period of time Tf until the leading edge of the sheet P arrives at the conveying rollers 130, as shown in FIG. 10E, and subsequently halts the pick roller 110 (timing t26).

Figure 15C:
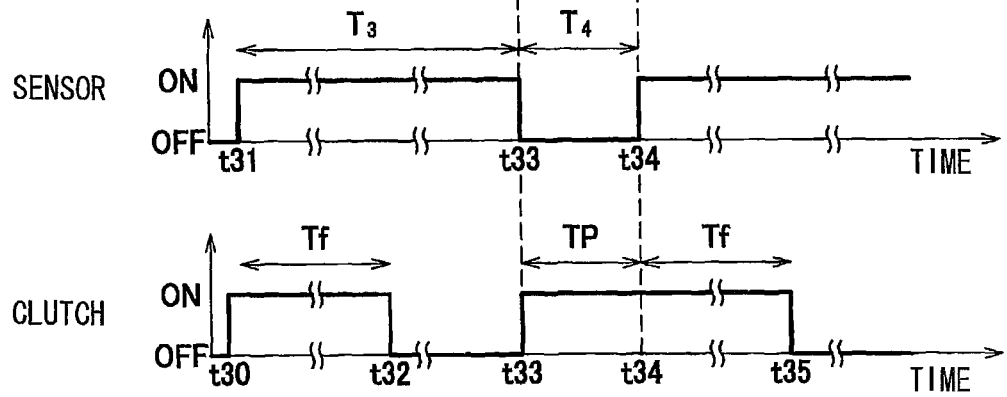
FIG. 15C is a timing chart showing a relationship between on/off of sensor and on/off of clutch during a double-feed with a large gap between sheets in the first modification.

Next, the operations performed by the sheet-feeding device 3 in the case of a double-feed (large gap between sheets) will be described with reference to FIGS. 15C and 11.

When the controller 180 executes the sheet-spacing control process, the trailing edge of the sheet P separates from the second arm 150, as shown in FIG. 11C. At this time, the second arm 150 moves to its non-detection position and the signal outputted from the sensor 160 changes to OFF (timing t33).

After the signal from the sensor 160 changes to OFF, the controller 180 executes the fourth drive control process to drive the pick roller 110 (timing t33). As the pick roller 110 rotates, the leading edge of the succeeding sheet P arrives at the second arm 150, as shown in FIG. 11D. Accordingly, both the first arm 140 and second arm 150 are now in the detection position and the signal outputted from the sensor 160 changes to ON (timing t34).

Since this example is for a double-feed (large gap between sheets), the elapsed time $T_3$ from the moment the signal inputted from the sensor 160 changes from OFF to ON after the controller 180 began driving the pick roller 110 in the second sheet-supply control process and until the inputted signal changes back to OFF (t31-t33) is longer than the third prescribed period of time TA, and the elapsed time $T_4$ from the moment that the controller 180 began driving the pick roller 110 according to the fourth drive control process and until the signal inputted from the sensor 160 changes from OFF to ON (t33-t34) is the fourth prescribed period of time TP. Accordingly, the controller 180 continues to drive the pick roller 110 during the second prescribed period of time Tf until the leading edge of the sheet P arrives at the conveying rollers 130, as shown in FIG. 11E, and subsequently executes the eighth halt control process to halt the pick roller 110 (timing t35).

Next, a variation of the single-feed control process will be described with reference to FIG. 16.

Figure 16:
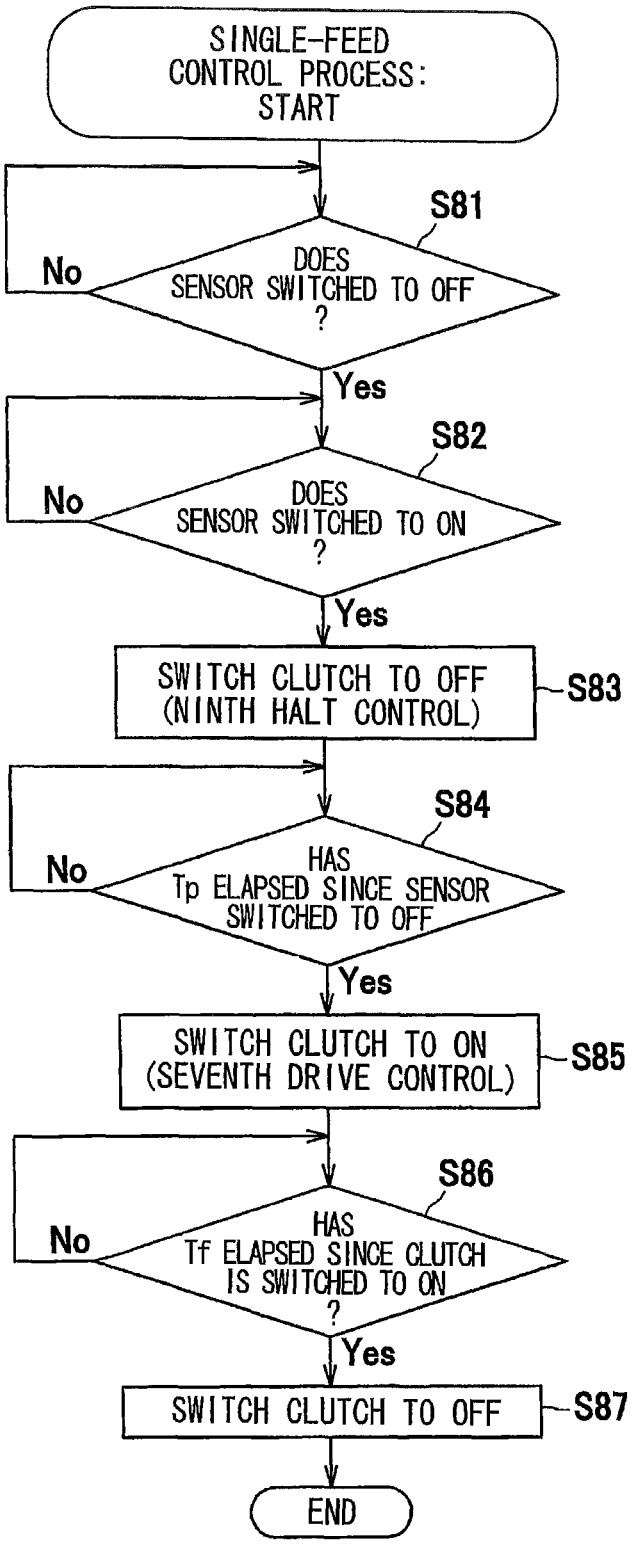
FIG. 16 is a flowchart illustrating steps in a single-feed control process according to a second modification.

In S81 of FIG. 16, the controller 180 determines whether the signal inputted from the sensor 160 has changed from ON to OFF. If the inputted signal has not changed to OFF at this time (S81: NO), the controller 180 waits until the inputted signal changes to OFF.

When the controller 180 determines that the inputted signal has changed to OFF (S81: YES), in S82 the controller 180 determines whether the signal inputted from the sensor 160 has changed back from OFF to ON.

If the inputted signal has not changed back to ON (S82: NO), the controller 180 waits until the signal changes to ON.

Once the controller 180 determines that the signal inputted from the sensor 160 has changed back to ON (S82: YES), in S83 the controller 180 executes a ninth halt control process for switching the clutch CL to OFF to halt the pick roller 110.

Next, the controller 180 determines whether the fourth prescribed period of time TP has elapsed since the moment that the sensor 160 was determined to be OFF in S81. If the fourth prescribed period of time TP has not elapsed at this time (S84: NO), the controller 180 continues to wait until the fourth prescribed period of time TP has elapsed.

If the controller 180 determines in S84 that the fourth prescribed period of time TP has elapsed (S84: YES), in S85 the controller 180 executes a seventh drive control process for switching the CL to ON and driving the pick roller 110. In S86 the controller 180 determines whether the second prescribed period of time Tf has elapsed since the clutch CL was switched to ON in S85. If the second prescribed period of time Tf has not elapsed at this time (S86: NO), the controller 180 continues to wait until the second prescribed period of time Tf has elapsed. When the controller 180 determines that the second prescribed period of time Tf has elapsed (S86: YES), in S87 the controller 180 switches the clutch CL to OFF and halts the pick roller 110.

Figure 17:
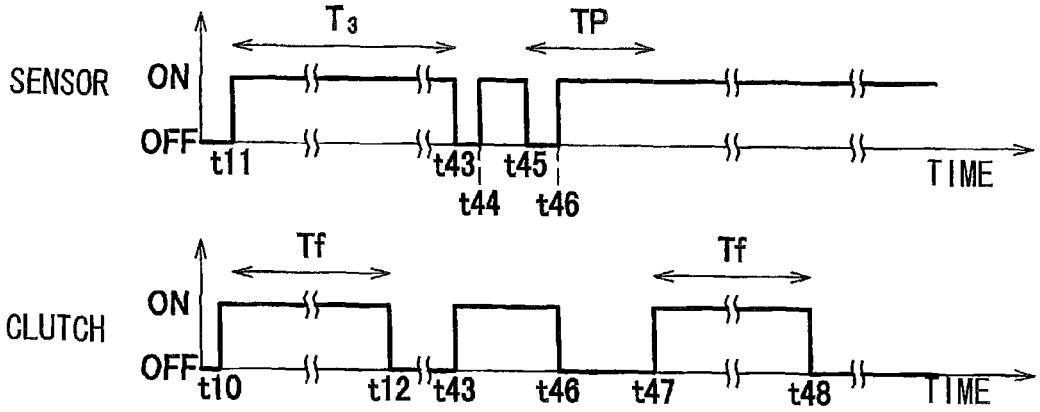
FIG. 17 is a timing chart showing a relationship between on/off of sensor and on/off of clutch during a single-feed in the second modification.

Next, the operations performed by the sheet-feeding device 3 having the above structure during a single-feed will be described with reference to FIGS. 17, 8, and 9.

When the controller 180 executes the sheet-spacing control process, the trailing edge of the sheet P separates from the first arm 140, as shown in FIG. 8C. At this point, the first arm 140 moves to the non-detection position and the signal inputted from the sensor 160 changes to OFF (timing t43).

When the signal inputted from the sensor 160 changes to OFF, the controller 180 executes the fourth drive control process for driving the pick roller 110 (timing t43) in order to convey the succeeding sheet P until the leading edge of the succeeding sheet P arrives at the first arm 140, as illustrated in FIG. 8D. Since the trailing edge of the preceding sheet P has not yet separated from the second arm 150, both the first arm 140 and second arm 150 are in their detection positions, and the signal inputted from the sensor 160 changes to ON (timing t44).

By continuing to rotate the pick roller 110 even though the signal inputted from the sensor 160 has changed to ON, the signal from the sensor 160 first changes to OFF as the trailing edge of the preceding sheet P separates from the second arm 150 (timing t45), and the signal from the sensor 160 again changes to ON as the leading edge of the succeeding sheet P arrives at the second arm 150 (timing t46), as illustrated in FIG. 9B. In this state, the controller 180 executes the ninth halt control process to halt the pick roller 110 (timing t46).

Once the fourth prescribed period of time TP has elapsed after the signal inputted from the sensor 160 changed to OFF due to the trailing edge of the preceding sheet P separating from the second arm 150, the controller 180 executes the seventh drive control process to drive the pick roller 110 (timing t47). Thereafter, the controller 180 continues driving the pick roller 110 during the second prescribed period of time Tf until the leading edge of the succeeding sheet P arrives at the conveying rollers 130, as shown in FIG. 9C, and subsequently halts the pick roller 110 (timing t48).

Further, in the preferred embodiment described above, the separator 120 is provided with the sloped part 121 and separating roller 123 for separating overlapped sheets P. However, the structure of the separator is not limited to the preferred embodiment. For example, the separator may be provided with only the separating roller. In this case, the first arm is provided between the pick roller and the separating roller.

What is claimed is:

1. A sheet-conveying apparatus comprising:

a tray configured to hold a plurality of sheets;

a pick roller configured to convey a sheet from the tray;

a control device configured to control the pick roller;

a separator disposed downstream of the pick roller in a conveying direction in which a sheet is conveyed, the separator being configured to separate a preceding sheet from a succeeding sheet when the preceding sheet and the succeeding sheet are conveyed by the pick roller in an overlapped state;

a conveyer disposed downstream of the separator in the conveying direction and configured to convey a sheet in the conveying direction;

a first arm disposed between the pick roller and a downstream end of the separator in the conveying direction, the first arm being configured to move from a non-detection position to a detection position when contacted by a sheet;

a second arm disposed downstream of the separator in the conveying direction and configured to move from a non-detection position to a detection position when contacted by a sheet; and a sensor configured to output a sensor-signal corresponding to positions of the first arm and the second arm, the sensor outputting a first signal when at least one of the first arm and the second arm is disposed in the non-detection position, the sensor outputting a second signal other than the first signal when both the first arm and the second arm are disposed in the detection positions.

2. The sheet-conveying apparatus according to claim 1, wherein the control device is configured to control the pick roller based on the sensor-signal.

3. The sheet-conveying apparatus according to claim 2, wherein the control device is configured to:

execute a first drive control process to drive the pick roller, if the sensor-signal changes from the second signal to the first signal; and execute a first halt control process to halt the pick roller, if a period of time from when driving of the pick roller is started by the first drive control process to when the sensor-signal changes the first signal to the second signal is shorter than a first prescribed period of time.

4. The sheet-conveying apparatus according to claim 3, wherein the control device is further configured to:

execute a second drive control process to drive the pick roller, if the sensor-signal changes from the second signal to the first signal within the first prescribed period of time since driving the pick roller is started by the first drive control process after the pick roller was halted by the first halt control process; and wait for a second prescribed period of time, if the sensor-signal changes from the first signal to the second signal after driving the pick roller was started by the second drive control process and execute a second halt control process to halt the pick roller after waiting for the second prescribed period of time.

5. The sheet-conveying apparatus according to claim 3, wherein the control device is further configured to:

execute a third drive control process to drive the pick roller, if the sensor-signal fails to change from the second signal to the first signal within the first prescribed period of time since driving the pick roller is started by the first drive control process after the first halt control process was executed; and wait for a second prescribed period of time after driving the pick roller was started by the third drive control process;

execute a third halt control process to halt the pick roller after waiting for the second prescribed period of time.

6. The sheet-conveying apparatus according to claim 3, wherein the control device is further configured to:

wait for a second prescribed period of time, if a period of time from when driving of the pick roller is started by the first drive control process to when the sensor-signal changes the first signal to the second signal is longer than the first prescribed period of time; and execute a fourth halt control process after waiting for the second prescribed period of time.

7. The sheet-conveying apparatus according to claim 1, wherein the first prescribed period of time is shorter than or equal to a period of time required for a trailing edge of a sheet to move from the first arm to the second arm.

8. The sheet-conveying apparatus according to claim 1, wherein the control device is further configured to execute a sheet-supply control process in which:

the pick roller is driven for a second prescribed period of time; and the pick roller is halted, after the sheet reaches the conveyer due by driving the pick roller for the second prescribed period of time.

9. The sheet-conveying apparatus according to claim 8, wherein the control device is further configured to execute a fourth drive control process to drive the pick roller, if the sensor-signal changes from the second signal to the first signal after the pick roller was halted by the sheet-supply control process.

10. The sheet-conveying apparatus according to claim 9, wherein the control device is further configured to execute a fifth halt control process to halt the pick roller, if an elapsed period of time is shorter than or equal to a third prescribed period of time when the sensor-signal changes from the first signal to the second signal after driving of the pick roller was started by the fourth drive control process, the elapsed period of time being a period of time from when driving of the pick roller is started by the sheet-supply control process to when the sensor-signal changes from the second signal to the first signal after the sensor-signal changed from the first signal to the second signal.

11. The sheet-conveying apparatus according to claim 10, wherein the control device is further configured to:

execute a fifth drive control process to drive the pick roller, if the sensor-signal changes from the second signal to the first signal after the pick roller is halted by the fifth halt control process; and wait for the second prescribed period of time if the sensor-signal changes from the first signal to the second signal after driving the pick roller was started by the fifth drive control process; and execute a sixth halt control process to halt the pick roller after waiting for the second prescribed period of time.

12. The sheet-conveying apparatus according to claim 10, wherein the control device is further configured to execute a seventh halt control process to halt the pick roller if following conditions (a) and (b) are met when the sensor-signal changes from the first signal to the second signal after driving of the pick roller was started by the fourth drive control process:

(a) a first elapsed period of time is longer than a third prescribed period of time, the first elapsed period time being a period of time from when driving of the pick roller is started by the sheet-supply control process to when the sensor-signal changes from the second signal to the first signal; and (b) a second elapsed period of time is shorter than a fourth prescribed period of time, the second elapsed period of time being a period of time from when driving of the pick roller is started by the fourth drive control process to when the sensor-signal changes from the first signal to the second signal.

13. The sheet-conveying apparatus according to claim 12, wherein the control device is further configured to:

wait until the fourth prescribed period of time elapses since driving of the pick roller is started by the fourth drive control process, after the pick roller is halted by the seventh halt control process; and execute a sixth drive control process to halt the pick roller after the fourth prescribed period of time has elapsed since driving of the pick roller is started by the fourth drive control process.

14. The sheet-conveying apparatus according to claim 12, wherein the control device is further configured to:

wait until the second prescribed period of time elapses since the signal output by the sensor changes from the first signal to the second signal, if following conditions (c) and (d) are met when the sensor-signal changes from the first signal to the second signal after driving of the pick roller was started by the fourth drive control process:

(c) a third elapsed period of time is longer than the third prescribed period of time, the third elapsed period time being a period of time from when driving of the pick roller is started by the sheet-supply control process to when the sensor-signal changes again from the second signal to the first signal after the sensor-signal changed from the first signal to the second signal; and (d) a fourth elapsed period of time is longer than or equal to the fourth prescribed period of time, the fourth elapsed period of time being a period of time from when driving of the pick roller is started by the fourth drive control process to when the sensor-signal changes from the first signal to the second signal; and execute an eighth halt control process to halt the pick roller after waiting until the second prescribed period of time elapses since the sensor-signal changes from the first signal to the second signal.

15. The sheet-conveying apparatus according to claim 9, wherein the control device is further configured to:

wait until the sensor-signal changes from the second signal to the first signal after the sensor-signal changed from the first signal to the second signal and execute a ninth halt control process to halt the pick roller, if an elapsed period of time is shorter than or equal to the third prescribed period of time when the signal that is outputted by the sensor changes from the first signal to the second signal after driving of the pick roller was started by the fourth drive control process, the elapsed period of time being a period of time from when driving of the pick roller is started by the sheet-supply control process to when the sensor-signal changes from the second signal to the first signal after the sensor-signal changed from the first signal to the second signal; and wait until the fourth prescribed period of time since the sensor-signal changes from the second signal to the first signal again after the signal changed from the first signal to the second signal after the pick roller has driven by the fourth drive control process and to execute a seventh drive control process to drive the pick roller, and execute a seventh drive control process to drive the pick roller, if the pick roller is halted by the ninth halt control process.

16. The sheet-conveying apparatus according to claim 12, wherein the fourth prescribed period of time is shorter than or equal to a period of time required for a trailing edge of a sheet to move from the first arm to the second arm.

17. The sheet-conveying apparatus according to claim 12, further comprising a detector configured to detect a sheet length conveyance time being a period of time from when a leading edge of a sheet passes a certain point to when a trailing edge of the sheet passes the certain point;

wherein the third prescribed period of time is shorted shorter than the sheet length conveyance time.

18. The sheet-conveying apparatus according to claim 17, wherein the third predetermined time is longer than a period of time resulting from subtracting a conveyance time from the sheet length conveyance time, the conveyance time being a period of time required for conveying a sheet from the first arm to the second arm.

19. The sheet-conveying apparatus according to claim 1, wherein the separator includes a separating roller;

wherein the first arm is disposed between the separating roller and the pick roller.

20. The sheet-conveying apparatus according to claim 1, wherein the tray includes a stacked portion configured to stack a sheet; wherein the separator includes a sloped part sloped relative to the stacked portion.

* * * * *